US007581519B2

(12) United States Patent
Hayase et al.

(10) Patent No.: US 7,581,519 B2
(45) Date of Patent: Sep. 1, 2009

(54) PHASE ADJUSTING APPARATUS AND A CAM SHAFT PHASE ADJUSTING APPARATUS FOR AN INTERNAL COMBUSTION ENGINE

(75) Inventors: Isao Hayase, Tsuchiura (JP); Seiji Suga, Kiyokawa (JP); Yoshinori Ichinosawa, Atsugi (JP); Tomoya Tsukada, Ebina (JP)

(73) Assignee: Hitachi, Ltd., Tokyo (JP)

( * ) Notice: Subject to any disclaimer, the term of this patent is extended or adjusted under 35 U.S.C. 154(b) by 206 days.

(21) Appl. No.: 11/834,963

(22) Filed: Aug. 7, 2007

(65) Prior Publication Data

US 2008/0047516 A1 Feb. 28, 2008

(30) Foreign Application Priority Data

Aug. 23, 2006 (JP) ..... 2006-226783

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 6,014,952 A * 1/2000 Sato et al. ..... 123/90.17

FOREIGN PATENT DOCUMENTS

JP 2000-179315 A 6/2000
JP 2000-213310 A 8/2000
JP 2005-330892 A 12/2005

* cited by examiner

*Primary Examiner*—Zelalem Eshete
(74) *Attorney, Agent, or Firm*—Crowell & Moring LLP

(57) ABSTRACT

A plurality of advanced angle chamber oil paths communicated to advanced angle hydraulic chambers and a plurality of retarded angle chamber oil paths communicated to retarded angle hydraulic chambers according to a change in rotating angle of a cam shaft are provided. The plurality of advanced angle chamber oil paths and the plurality of retarded angle chamber oil paths, respectively, are switched between communication and cut-off according to a rotating angle of the cam shaft. When torque in the direction of advanced angle acts in an advanced angle mode for phase shifting in the direction of advanced angle, the advanced angle hydraulic chambers are caused to communicate to a hydraulic power source and the retarded angle hydraulic chambers are caused to communicate to a drain. Also, at high speed of an engine, in the advanced angle mode, shut-off valves in the advanced angle chamber oil paths and the retarded angle chamber oil paths are opened so that hydraulic pressure is communicated from the hydraulic power source to the advanced angle chambers at all times in the same manner as in the related art.

11 Claims, 20 Drawing Sheets

PHASE ADJUSTING APPARATUS AND A CAM SHAFT PHASE ADJUSTING APPARATUS FOR AN INTERNAL COMBUSTION ENGINE

BACKGROUND OF THE INVENTION

The present invention relates to a control device for a phase angle between two rotating members, and more particular, to a cam shaft phase adjusting apparatus for internal combustion engines, which adjusts timing, at which an intake valve or an exhaust valve driven by a crankshaft through a cam shaft is opened or closed.

Presently, the mainstream in cam shaft phase adjusting apparatuses for internal combustion engines, used in automobile engines, that is, variable valve timing controls (VTC) resides in apparatuses driven by hydraulic pressure supplied from an oil pump, which is belt-driven by an engine. Therefore, there is caused a problem that in a state, in which an engine is rotated at low speed as at the time of idling, VTC is decreased in speed of response since hydraulic pressure as supplied is low and so a sufficient driving force cannot be generated. Reduction in $CO_2$ emission becomes important in a situation, in which regulations for exhaust gases become strict all over the world, so that it becomes necessary to improve VTC in speed of response even at the time of idling and to constantly exercise rapid control at ideal valve timing according to an operating condition.

As measures for improvement of VTC in speed of response even at low hydraulic pressure, there is proposed a cam shaft phase adjusting apparatus for internal combustion engines, described in "Variable valve timing control" of, for example, JP-A-2000-213310 and making use of fluctuating torque generated on a cam shaft over positive and negative ranges. Disclosed therein is a cam shaft phase adjusting apparatus for internal combustion engines, in which a check valve provides communication between hydraulic chambers, which vary in volume interlocking with relative rotation between a first rotating member rotationally driven by a crankshaft of an engine and a second rotating member fixed to a cam shaft, and the check valve switches over a direction, in which flow is allowed, whereby phase of the cam shaft relative to the crankshaft is changed in an optional one of both directions of retarded and advanced angles by a valve spring with fluctuating torque generated on the cam shaft as a driving force.

Also, as the related art for improvement of VTC in speed of response at low hydraulic pressure, there is proposed a cam shaft phase adjusting apparatus for internal combustion engines, described in "Valve timing control for internal combustion engines" of, for example, JP-A-2000-179315. The JP-A-2000-179315 discloses a cam shaft phase adjusting apparatus for internal combustion engines, in which an oil supply path of a hydraulic VTC to an advanced angle chamber is intermittently opened and closed in synchronous with rotation of a cam shaft to prevent fluctuating torque from generating reverse rotation in a direction of retarded angle in phase shift in a direction of advanced angle whereby speed of response is improved.

Since the check valve provided on the communication path between the hydraulic chambers permits flow of an oil in one direction but inhibits flow of an oil in the other direction in the related art disclosed in JP-A-2000-213310, however, the relative rotation between the first rotating member which interlocks with a volumetric change of the hydraulic chambers and the second rotating member which is fixed to the cam shaft is permitted in the one direction and a torque part of one of signs of that cam shaft fluctuating torque, which fluctuates over positive and negative ranges, causes relative rotation in the direction as permitted.

At this time, that mechanism, in which the check valve inhibits flow in a reverse direction, is a passive operation, in which torque of a sign in the reverse direction causes an oil to begin to counterflow to close the check valve, and certainly involves time lag. Thereby, there is caused a problem that when fluctuating torque of the cam shaft gets into high frequency at the time of high speed operation of the engine, opening and closing movements of the check valve cannot follow this and the apparatus cannot function as a phase shift apparatus. Also, there is caused a problem that a decrease in speed of response is caused corresponding to some reverse rotation generated until a reverse rotation preventing function works.

Also, the related art disclosed in JP-A-2000-179315 discloses a construction, in which intermittent oil supply achieves an improvement in speed of response mainly in the direction of advanced angle, and a construction, in which phase shift in the direction of advanced angle is switched over to a conventional, continuous oil supply by a change in hydraulic pressure. Switchover to the conventional, continuous oil supply aims at inhibiting intermittent oil supply in high speed operation, in which sufficient hydraulic pressure is obtained, from becoming conversely responsible for a disadvantage such as a decrease in speed of response, a water hammer phenomenon in hydraulic pressure paths, etc.

Since JP-A-2000-179315 does not disclose any specific construction, in which a high response at the time of phase shift in the direction of retarded angle and switchover to continuous oil supply are realized at the same time, however, there is caused a problem that the effect of high response at low speed is not ensured at the time of phase shift in both the direction of advanced angle and the direction of retarded angle and that an effect of inhibiting a disadvantage at high speed, which is obtained by switchover to continuous oil supply, cannot be ensured at the time of phase shift in both the direction of advanced angle and the direction of retarded angle.

It is an object of the invention to provide a cam shaft phase adjusting apparatus for internal combustion engines, which is excellent in practicability and high in response and which is higher in response than a conventional one at the time of low speed (low hydraulic pressure) and eliminates generation of a new disadvantage such as a water hammer phenomenon, etc. while ensuring the same, high response as that in a conventional one at the time of high speed (high hydraulic pressure) in that phase shift in both the direction of advanced angle and the direction of retarded angle, which is certainly carried out in a cam shaft phase adjusting apparatus.

SUMMARY OF THE INVENTION

In order to solve the problems described above, the invention mainly adopts the following construction.

The construction resides in a cam shaft phase adjusting apparatus for internal combustion engines, having phase shift means, which performs phase shift between a crankshaft and a cam shaft and includes an advanced angle hydraulic chamber, which is increased in volume when a phase angle of the cam shaft relative to the crankshaft changes in a direction of advanced angle, and a retarded angle hydraulic chamber, which is increased in volume when a phase angle of the cam shaft relative to the crankshaft changes in a direction of retarded angle, and wherein there are provided a plurality of advanced angle chamber oil path systems communicated to the advanced angle hydraulic chamber and a plurality of retarded angle chamber oil path systems communicated to the retarded angle hydraulic chamber according to a change in rotating angle of the cam shaft, and a switchover unit is provided to switch communication and cut-off according to a rotating angle of the cam shaft such that one of the plurality of advanced angle chamber oil path systems is put in a state of being cut off from the advanced angle hydraulic chamber in a state, in which the other of the plurality of advanced angle chamber oil path systems is communicated to the advanced angle hydraulic chamber, and one of the plurality of retarded angle chamber oil path systems is put in a state of being cut off from the retarded angle hydraulic chamber in a state, in which the other of the plurality of retarded angle chamber oil path systems is communicated to the retarded angle hydraulic chamber.

Also, the construction resides in a cam shaft phase adjusting apparatus for internal combustion engines, having phase shift means, which performs phase shift between a crankshaft and a cam shaft and includes an advanced angle hydraulic chamber, which is increased in volume when a phase angle of the cam shaft relative to the crankshaft changes in a direction of advanced angle, and a retarded angle hydraulic chamber, which is increased in volume when a phase angle of the cam shaft relative to the crankshaft changes in a direction of retarded angle, and comprising first and second oil path systems, which are independent from each other and communicated to the advanced angle hydraulic chamber in respective ranges of predetermined rotating angles according to a change in rotating angle of the cam shaft, third and fourth oil path systems, which are independent from each other and communicated to the retarded angle hydraulic chamber in respective ranges of predetermined rotating angles according to a change in rotating angle of the cam shaft, a first switchover unit, which performs switching between communication and cut-off according to a rotating angle of the cam shaft such that one of the first and second oil path systems is put in a state of being cut off from the advanced angle hydraulic chamber in a state, in which the other of the first and second oil path systems is communicated to the advanced angle hydraulic chamber, and a second switchover unit, which performs switching between communication and cut-off according to a rotating angle of the cam shaft such that one of the third and fourth oil path systems is put in a state of being cut off from the retarded angle hydraulic chamber in a state, in which the other of the third and fourth oil path systems is communicated to the retarded angle hydraulic chamber.

Also, the construction resides in a cam shaft phase adjusting apparatus for internal combustion engines, having phase shift means, which performs phase shift between a crankshaft and a cam shaft and includes an advanced angle hydraulic chamber, which is increased in volume when a phase angle of the cam shaft relative to the crankshaft changes in a direction of advanced angle, and a retarded angle hydraulic chamber, which is increased in volume when a phase angle of the cam shaft relative to the crankshaft changes in a direction of retarded angle, and comprising first and second oil path systems, which are communicated to the advanced angle hydraulic chamber in respective ranges of predetermined angles when a phase angle of the cam shaft relative to the crankshaft changes, and third and fourth oil path systems, which are communicated to the retarded angle hydraulic chamber in respective ranges of predetermined angles when a phase angle of the cam shaft relative to the crankshaft changes, and wherein the first and second oil path systems are provided as mutually independent oil path systems and provided to have a range of phase angle so that one of them is put in a state of being cut off from the advanced angle hydraulic chamber when the other is communicated to the advanced angle hydraulic chamber, and the third and fourth oil path systems are provided as mutually independent oil path systems and provided to have a range of phase angle so that one of them is put in a state of being cut off from the retarded angle hydraulic chamber when the other is communicated to the retarded angle hydraulic chamber, the apparatus further comprising a fifth oil path system communicated to the advanced angle hydraulic chamber at all times and a sixth oil path system communicated to the retarded angle hydraulic chamber at all times.

Also, the construction resides in a cam shaft phase adjusting apparatus for internal combustion engines, having phase shift means, which performs phase shift between a crankshaft and a cam shaft and includes an advanced angle hydraulic chamber, which is increased in volume when a phase angle of the cam shaft relative to the crankshaft changes in a direction of advanced angle, and a retarded angle hydraulic chamber, which is increased in volume when a phase angle of the cam shaft relative to the crankshaft changes in a direction of retarded angle, and comprising a plurality of advanced angle chamber oil path systems communicated to the advanced angle hydraulic chamber according to a rotating angle of the cam shaft, a plurality of retarded angle chamber oil path systems communicated to the retarded angle hydraulic chamber according to a rotating angle of the cam shaft, an intermittent switchover unit for switching between communication and cut-off according to a rotating angle of the cam shaft such that one of the plurality of advanced angle chamber oil path systems is cut off from the advanced angle hydraulic chamber in a state, in which the other of the plurality of advanced angle chamber oil path systems is communicated to the advanced angle hydraulic chamber, and one of the plurality of retarded angle chamber oil path systems is cut off from the retarded angle hydraulic chamber in a state, in which the other of the plurality of retarded angle chamber oil path systems is communicated to the retarded angle hydraulic chamber, and a communication switchover unit, which provides communication or cut-off between the plurality of advanced angle chamber oil path systems and provides communication or cut-off between the plurality of retarded angle chamber oil path systems according to a rotating angle of the cam shaft.

According to the invention, it is possible to use an intermittent oil supply system to surely prevent reverse rotation (that phase shift in the direction of retarded angle, which is caused by fluctuating torque in the direction of retarded angle, for example, when phase shift in the direction of advanced angle is desired) by fluctuating torque at low speed (low hydraulic pressure), thus enabling producing an effect of high response to the maximum both in the direction of advanced angle and in the direction of retarded angle.

Also, at high speed (high hydraulic pressure), at which sufficient hydraulic pressure is obtained, it is possible to ensure the same high speed of response as conventional ones by issuing a command from outside at need for switchover to a conventional, continuous oil supply system, and to avoid generation of a disadvantage such as a water hammer phenomenon, etc. in oil supply paths. Thereby, the technology of high responsiveness, which is high in practicability, at low speed is obtained.

Other objects, features and advantages of the invention will become apparent from the following description of the embodiments of the invention taken in conjunction with the accompanying drawings.

DESCRIPTION OF THE PREFERRED EMBODIMENTS

A cam shaft phase adjusting apparatus for internal combustion engines, according to embodiments of the invention, will be described in detail with reference to the drawings. In addition, the embodiments provide examples of a construction, to which the invention is applied as a cam shaft phase adjusting apparatus for inline four-cylinder type engines.

Figure 1:
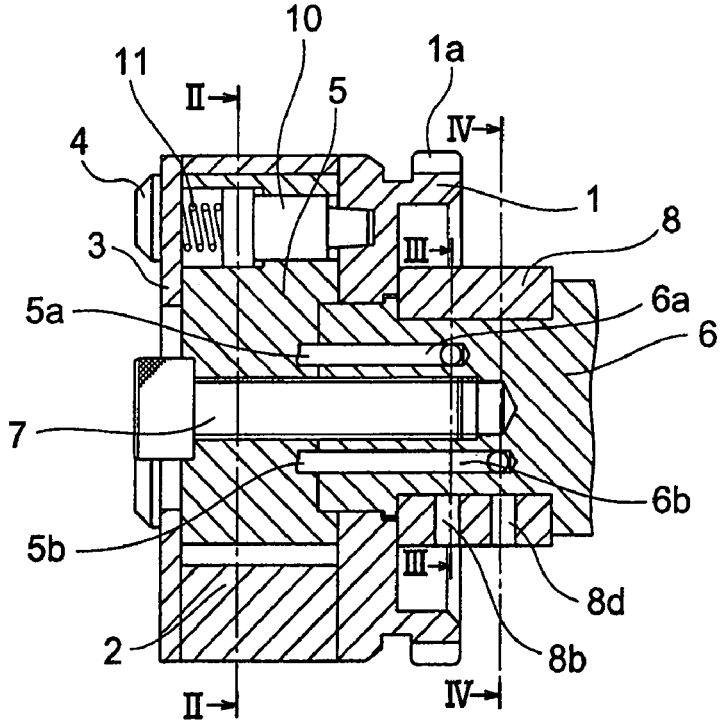
FIG. 1 is a side, cross sectional view showing a cam shaft phase adjusting apparatus for internal combustion engines according to a first embodiment of the invention and taken along the line I-I in FIG. 2.
Figure 2:
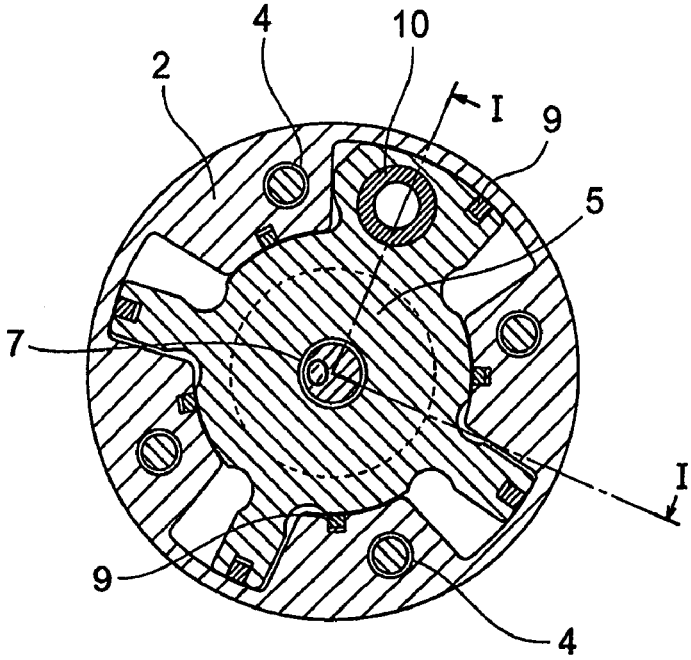
FIG. 2 is a cross sectional view showing the cam shaft phase adjusting apparatus according to the first embodiment and taken along the line II-II in FIG. 1.
Figure 3:
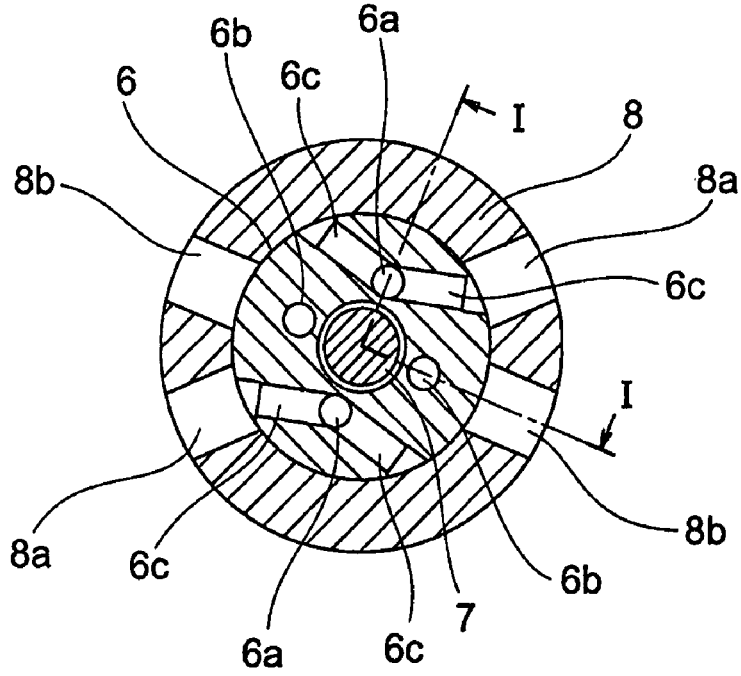
FIG. 3 is a cross sectional view showing hydraulic pressure paths to advanced angle hydraulic chambers in the cam shaft phase adjusting apparatus according to the first embodiment and taken along the line III-III in FIG. 1.
Figure 4:
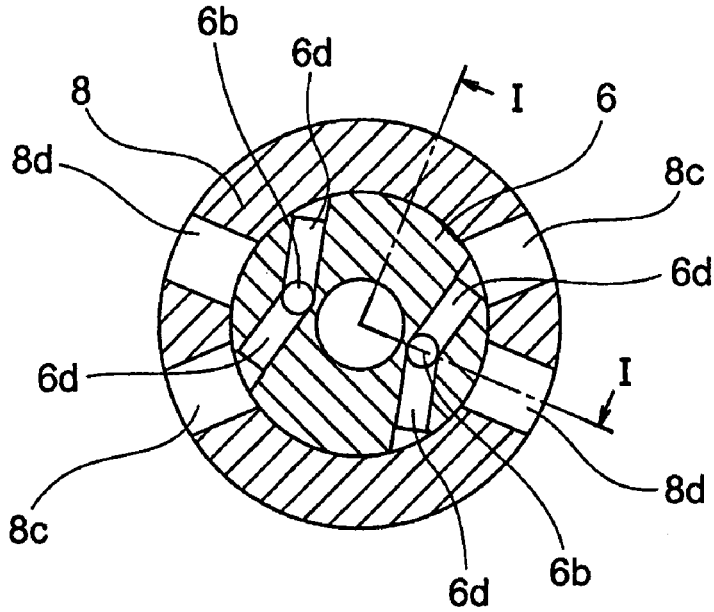
FIG. 4 is a cross sectional view showing hydraulic pressure paths to retarded angle hydraulic chambers in the cam shaft phase adjusting apparatus according to the first embodiment and taken along the line IV-IV in FIG. 1.

FIG. 1 is a side, cross sectional view showing a cam shaft phase adjusting apparatus for internal combustion engines according to a first embodiment of the invention and taken along the line I-I in FIG. 2. FIG. 2 is a cross sectional view showing the cam shaft phase adjusting apparatus according to the first embodiment and taken along the line II-II in FIG. 1. FIG. 3 is a cross sectional view showing hydraulic pressure paths to advanced angle hydraulic chambers in the cam shaft phase adjusting apparatus according to the first embodiment and taken along the line III-III in FIG. 1. FIG. 4 is a cross sectional view showing hydraulic pressure paths to retarded angle hydraulic chambers in the cam shaft phase adjusting apparatus according to the first embodiment and taken along the line IV-IV in FIG. 1.

Figure 5:
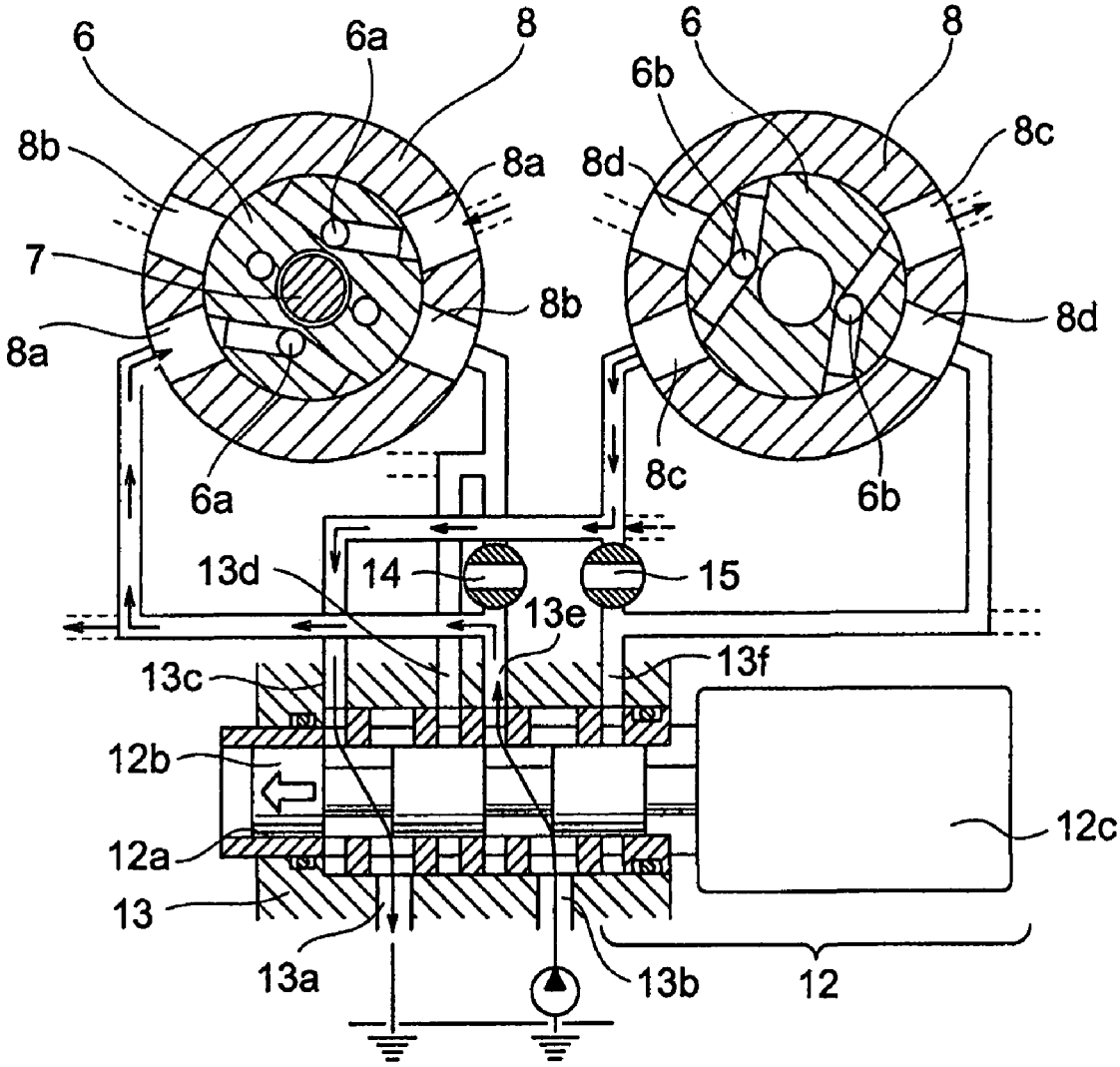
FIG. 5 is a view showing a configuration of oil supply paths when a cam shaft fluctuating torque is in a direction of advanced angle in the case where the cam shaft phase adjusting apparatus according to the first embodiment is driven in intermittent oil supply in the direction of advanced angle.
Figure 6:
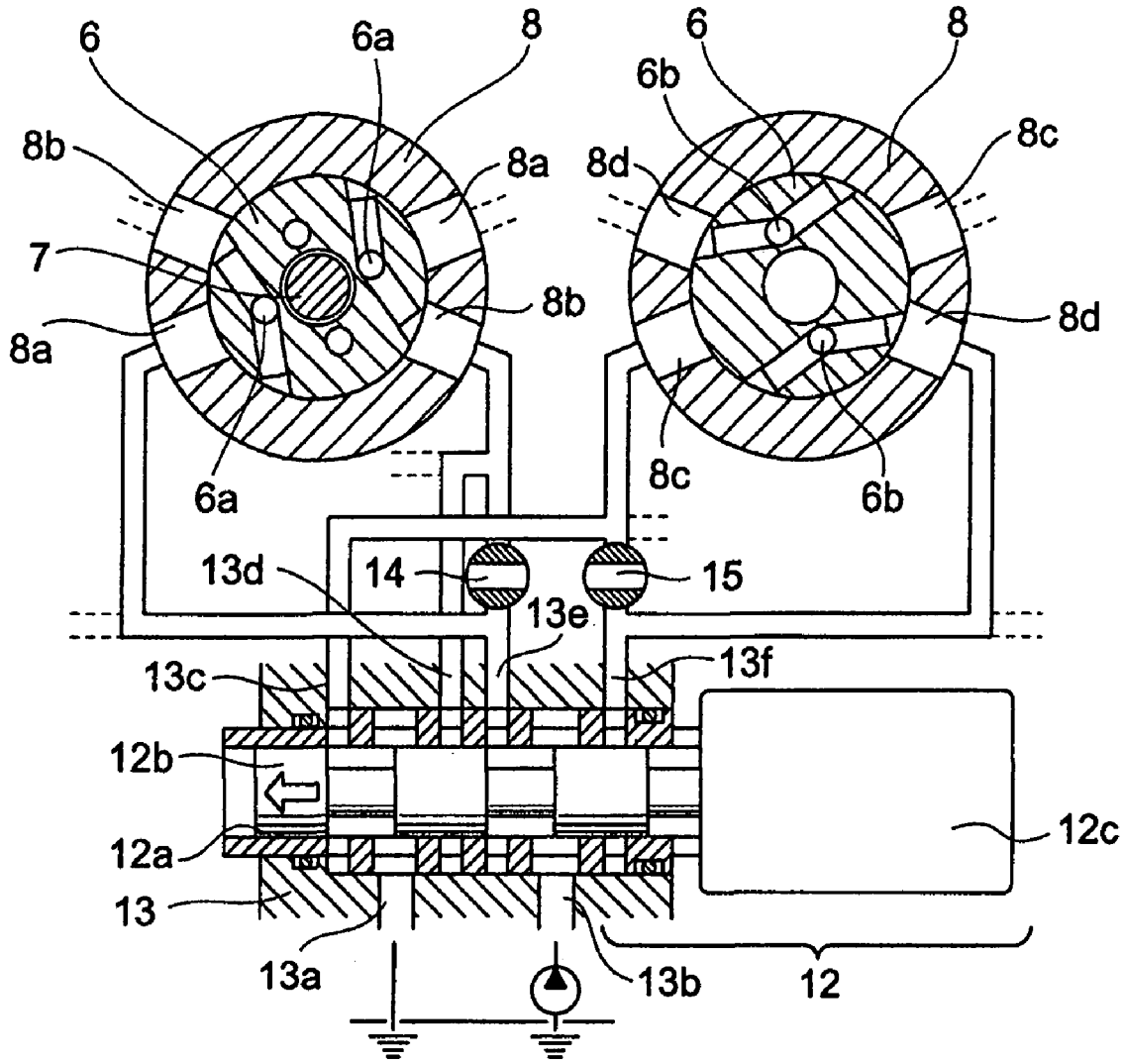
FIG. 6 is a view showing a configuration of oil supply paths when a cam shaft fluctuating torque is in a direction of retarded angle in the case where the cam shaft phase adjusting apparatus according to the first embodiment is driven in intermittent oil supply in the direction of retarded angle.
Figure 7:
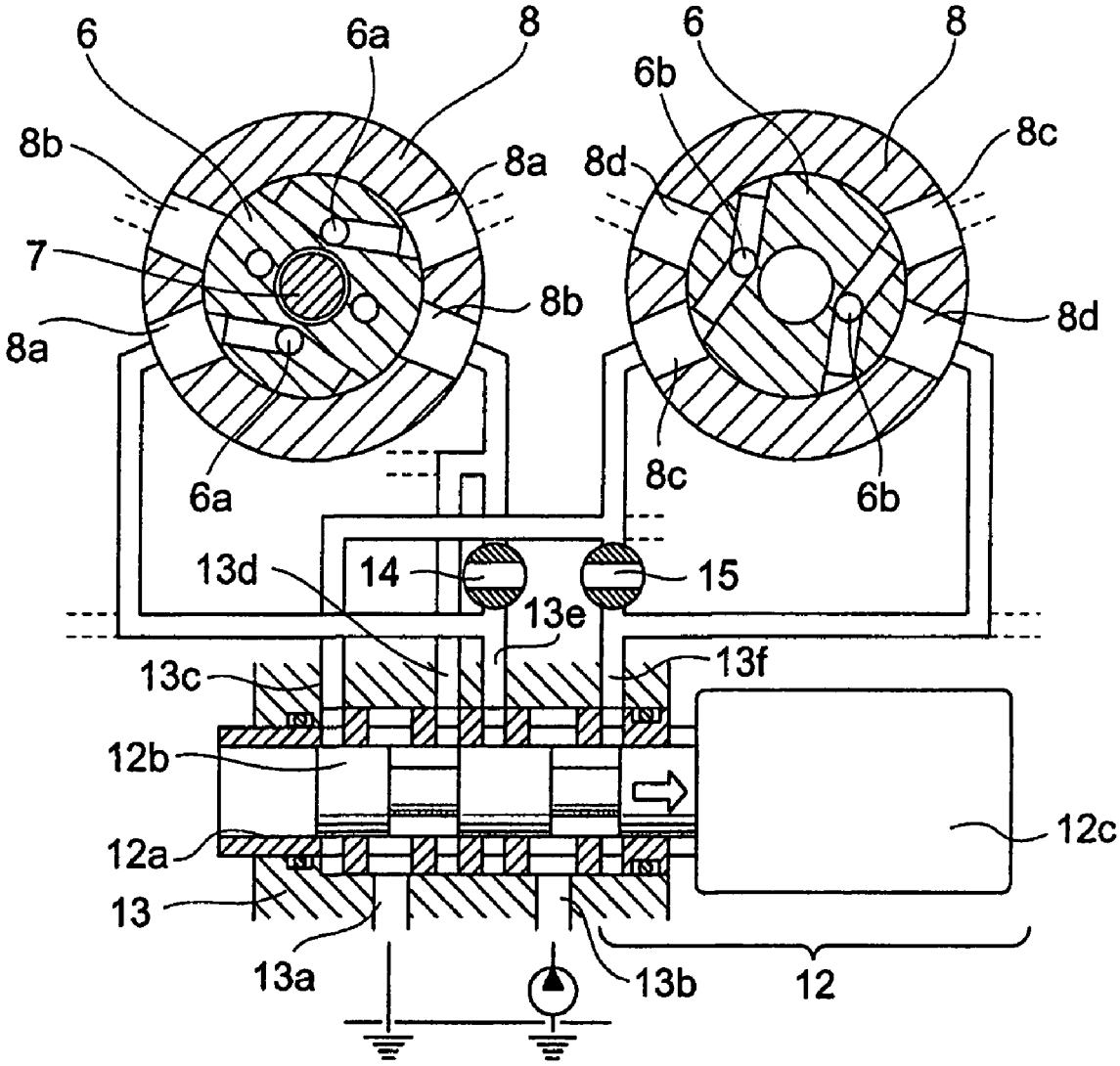
FIG. 7 is a view showing a configuration of oil supply paths when a cam shaft fluctuating torque is in the direction of advanced angle in the case where the cam shaft phase adjusting apparatus according to the first embodiment is driven in intermittent oil supply in the direction of retarded angle.
Figure 8:
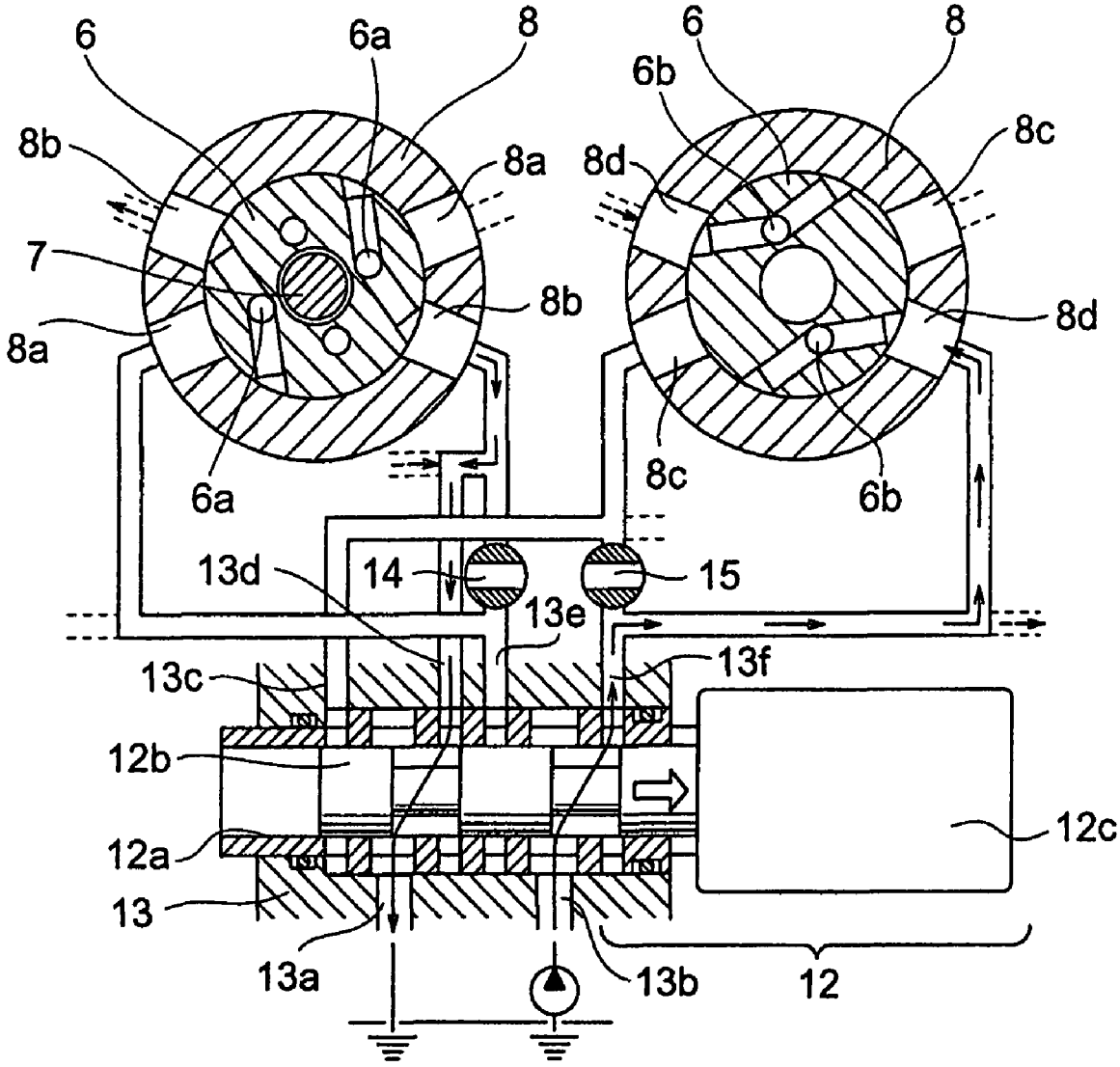
FIG. 8 is a view showing a configuration of oil supply paths when a cam shaft fluctuating torque is in the direction of retarded angle in the case where the cam shaft phase adjusting apparatus according to the first embodiment is driven in intermittent oil supply in the direction of retarded angle.
Figure 9:
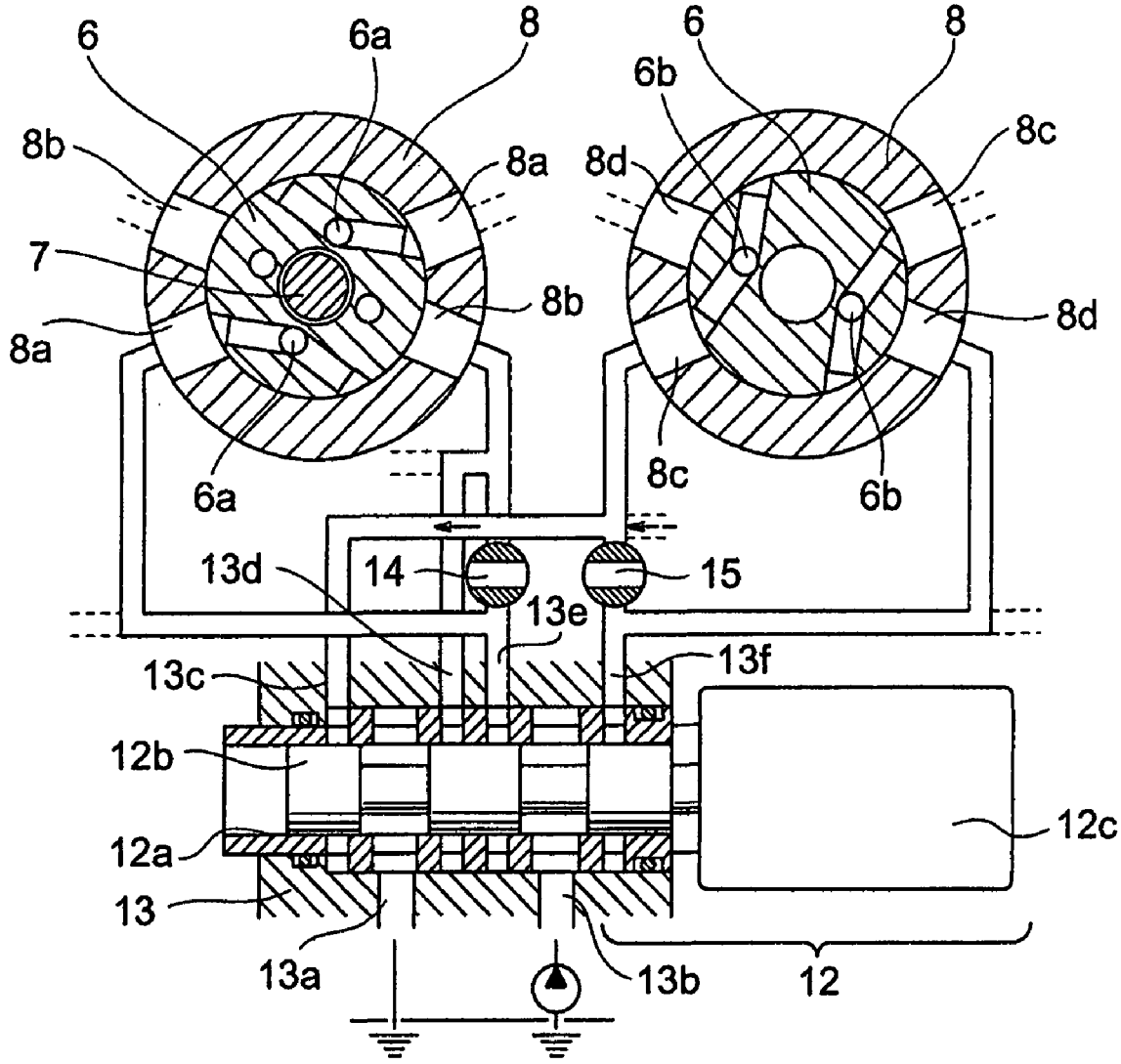
FIG. 9 is a view showing a configuration of oil supply paths when a cam shaft fluctuating torque is in the direction of advanced angle in the case where the cam shaft phase adjusting apparatus according to the first embodiment is fixed to a predetermined phase in intermittent oil supply.
Figure 10:
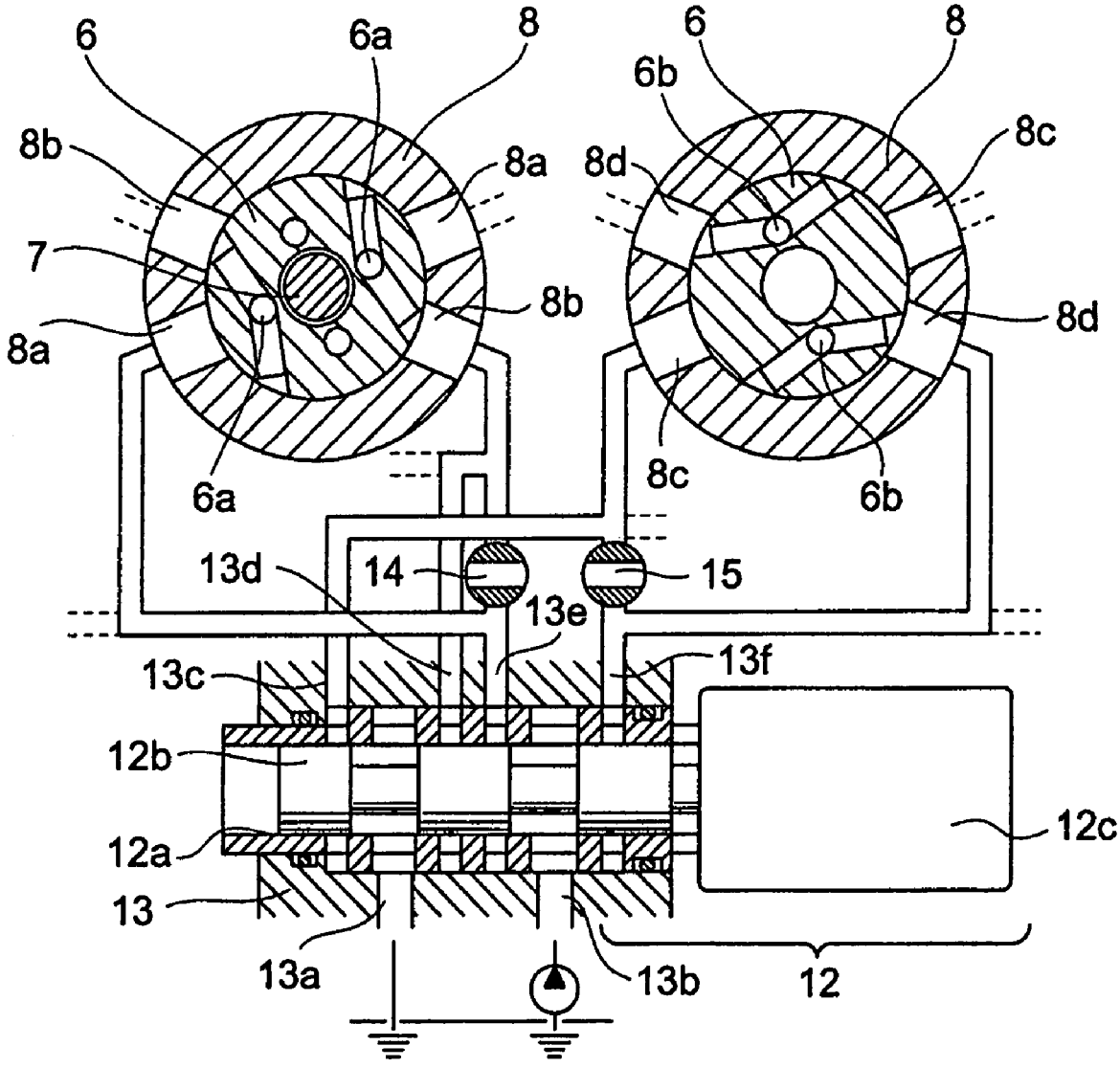
FIG. 10 is a view showing a configuration of oil supply paths when a cam shaft fluctuating torque is in the direction of retarded angle in the case where the cam shaft phase adjusting apparatus according to the first embodiment is fixed to a predetermined phase in intermittent oil supply.

Also, FIG. 5 is a view showing a configuration of oil supply paths when a cam shaft fluctuating torque is in a direction of advanced angle in the case where the cam shaft phase adjusting apparatus according to the first embodiment is driven in intermittent oil supply in the direction of advanced angle. FIG. 6 is a view showing a configuration of oil supply paths when a cam shaft fluctuating torque is in a direction of retarded angle in the case where the cam shaft phase adjusting apparatus according to the first embodiment is driven in intermittent oil supply in the direction of retarded angle. FIG. 7 is a view showing a configuration of oil supply paths when a cam shaft fluctuating torque is in the direction of advanced angle in the case where the cam shaft phase adjusting apparatus according to the first embodiment is driven in intermittent oil supply in the direction of retarded angle. FIG. 8 is a view showing a configuration of oil supply paths when a cam shaft fluctuating torque is in the direction of retarded angle in the case where the cam shaft phase adjusting apparatus according to the first embodiment is driven in intermittent oil supply in the direction of retarded angle. FIG. 9 is a view showing a configuration of oil supply paths when a cam shaft fluctuating torque is in the direction of advanced angle in the case where the cam shaft phase adjusting apparatus according to the first embodiment is fixed to a predetermined phase in intermittent oil supply. FIG. 10 is a view showing a configuration of oil supply paths when a cam shaft fluctuating torque is in the direction of retarded angle in the case where the cam shaft phase adjusting apparatus according to the first embodiment is fixed to a predetermined phase in intermittent oil supply.

Figure 11:
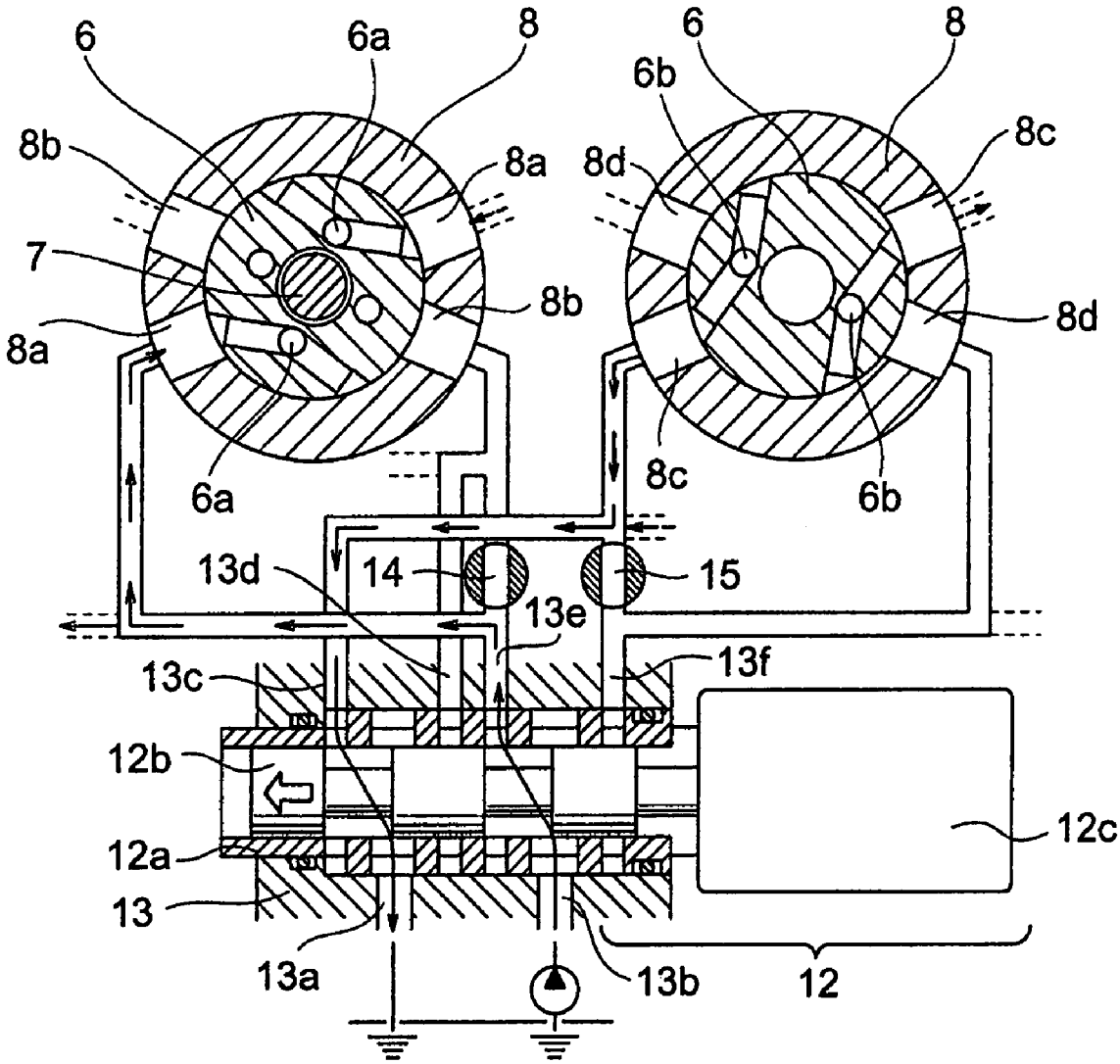
FIG. 11 is a view showing a configuration of oil supply paths when a cam shaft fluctuating torque is in the direction of advanced angle in the case where the cam shaft phase adjusting apparatus according to the first embodiment is driven in continuous oil supply in the direction of advanced angle.
Figure 12:
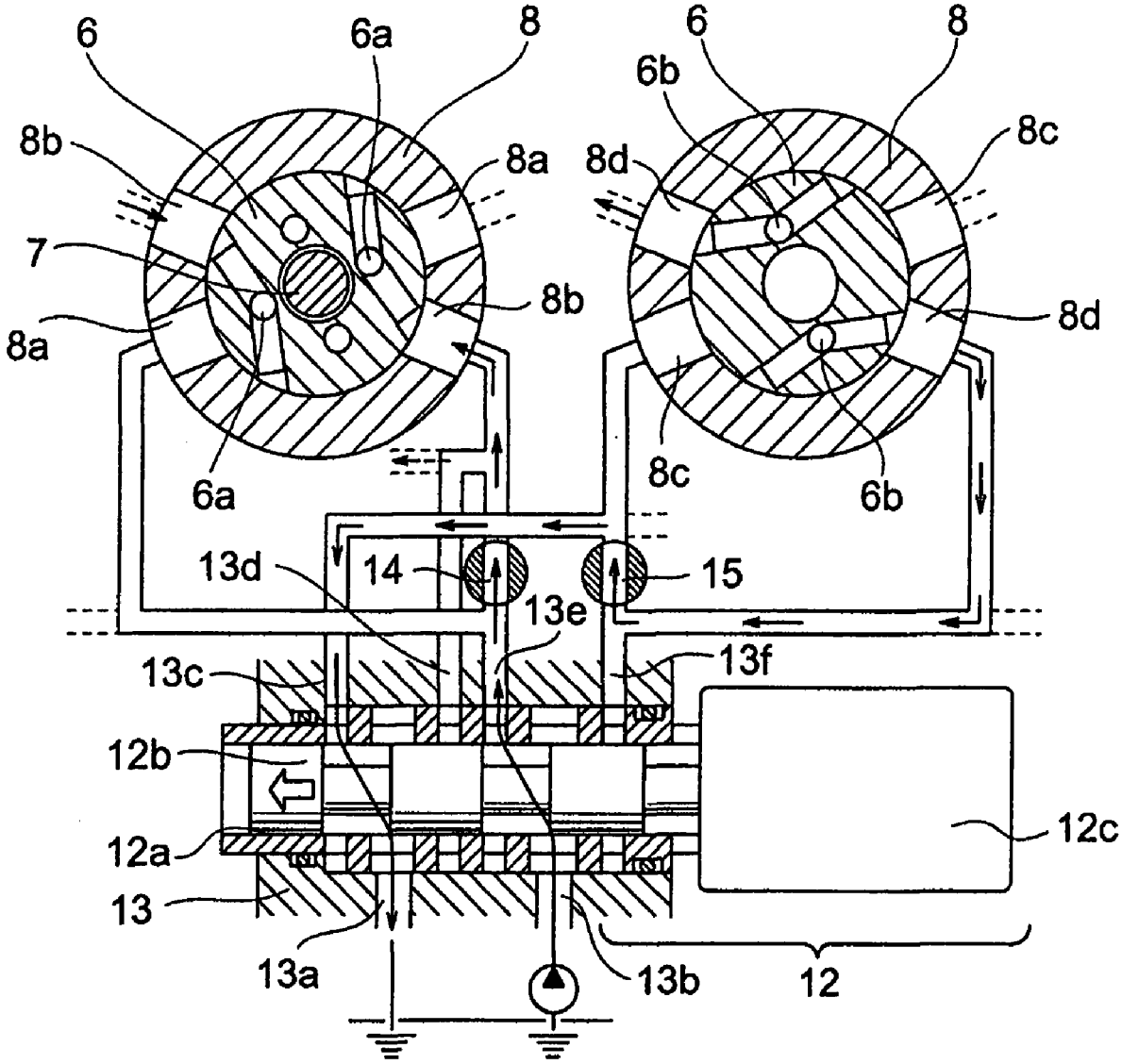
FIG. 12 is a view showing a configuration of oil supply paths when a cam shaft fluctuating torque is in the direction of retarded angle in the case where the cam shaft phase adjusting apparatus according to the first embodiment is driven in continuous oil supply in the direction of advanced angle.
Figure 13:
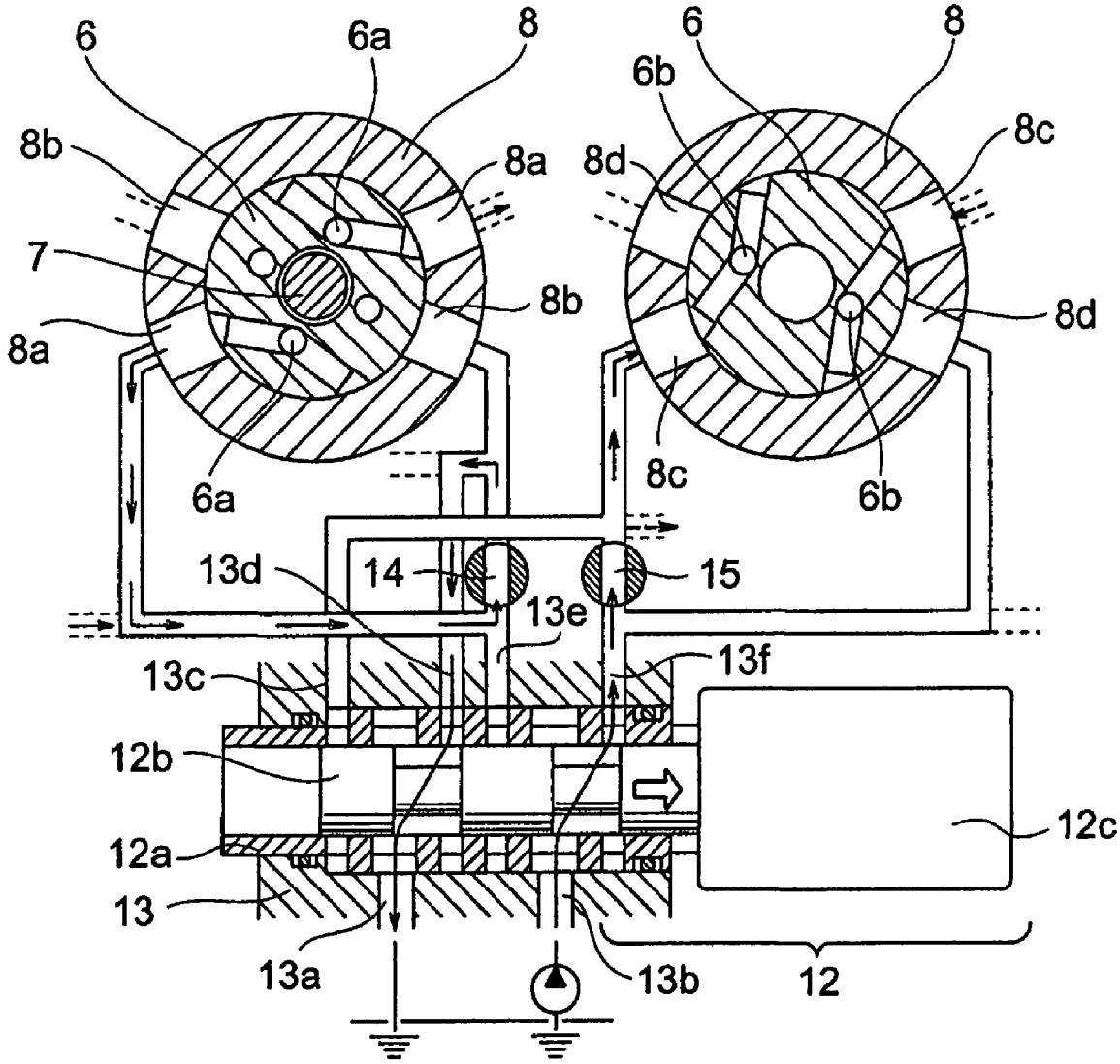
FIG. 13 is a view showing a configuration of oil supply paths when a cam shaft fluctuating torque is in the direction of advanced angle in the case where the cam shaft phase adjusting apparatus according to the first embodiment is driven in continuous oil supply in the direction of retarded angle.
Figure 14:
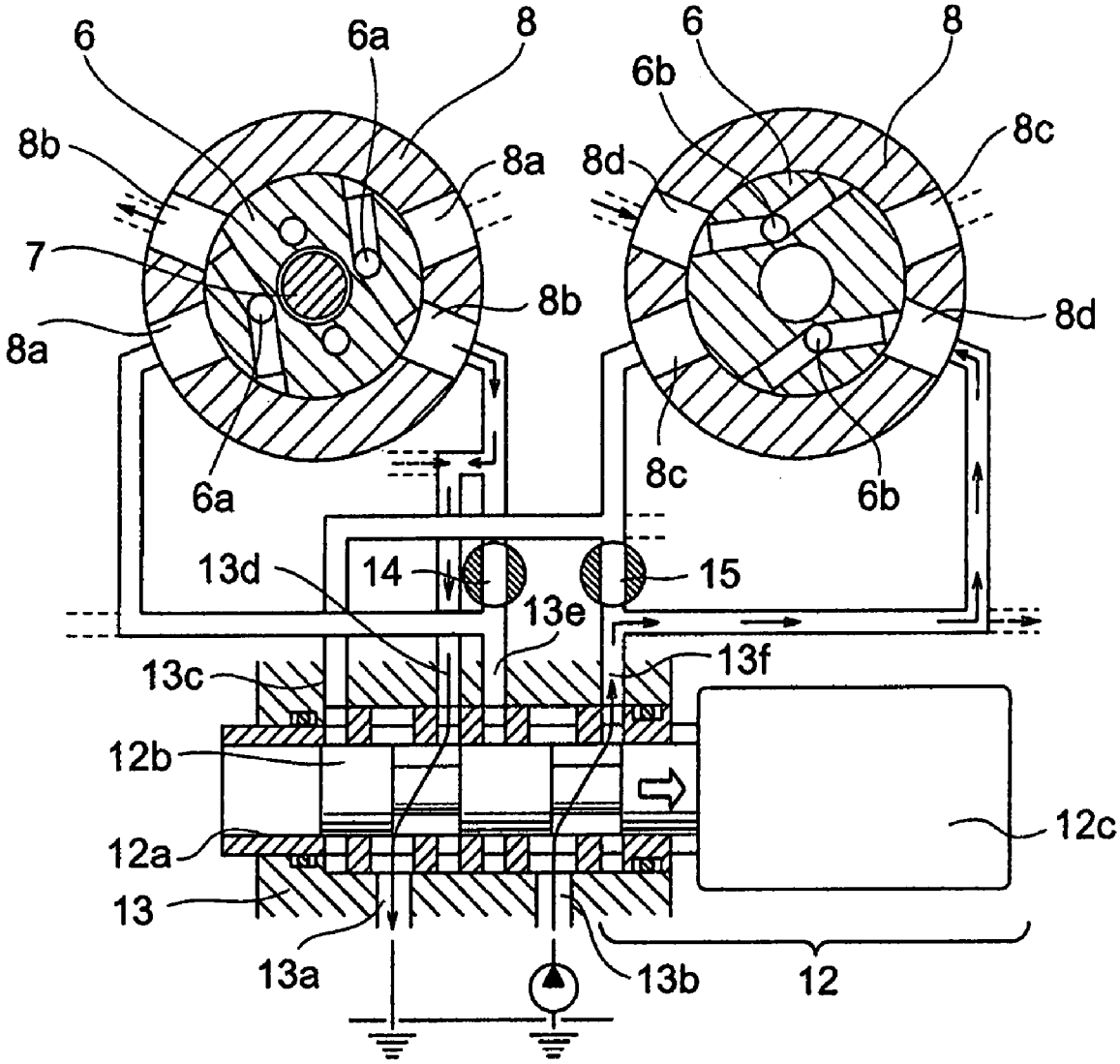
FIG. 14 is a view showing a configuration of oil supply paths when a cam shaft fluctuating torque is in the direction of retarded angle in the case where the cam shaft phase adjusting apparatus according to the first embodiment is driven in continuous oil supply in the direction of retarded angle.

Also, FIG. 11 is a view showing a configuration of oil supply paths when a cam shaft fluctuating torque is in the direction of advanced angle in the case where the cam shaft phase adjusting apparatus according to the first embodiment is driven in continuous oil supply in the direction of advanced angle. FIG. 12 is a view showing a configuration of oil supply paths when a cam shaft fluctuating torque is in the direction of retarded angle in the case where the cam shaft phase adjusting apparatus according to the first embodiment is driven in continuous oil supply in the direction of advanced angle. FIG. 13 is a view showing a configuration of oil supply paths when a cam shaft fluctuating torque is in the direction of advanced angle in the case where the cam shaft phase adjusting apparatus according to the first embodiment is driven in continuous oil supply in the direction of retarded angle. FIG. 14 is a view showing a configuration of oil supply paths when a cam shaft fluctuating torque is in the direction of retarded angle in the case where the cam shaft phase adjusting apparatus according to the first embodiment is driven in continuous oil supply in the direction of retarded angle.

In FIGS. 1 to 4, a sprocket 1 being a first rotating member is rotationally driven by a crankshaft of an engine while being reduced to ½ in speed through a toothed belt (not shown), which meshes with a toothed portion 1*a* on an outer periphery thereof. Also, a body 2 and a front plate 3 are fixed to and made integral with the sprocket 1 by means of assembly bolts 4. A vane 5 being a second rotating member is fixed to a cam shaft 6 by a center bolt 7. In FIG. 2, the whole cam shaft phase adjusting apparatus is rotationally driven in a clockwise direction and four pairs of retarded angle hydraulic chambers and advanced angle hydraulic chambers are formed between the body 2 and the vane 5. Spaces in a clockwise, rotating direction of the vane 5 constitute the retarded angle hydraulic chambers and spaces in a counterclockwise, rotating direction constitute the advanced angle hydraulic chambers. FIG. 2 shows a state, in which the retarded angle hydraulic chambers are maximum in volume and phase of the cam shaft phase adjusting apparatus is a maximum retarded angle. Openings at both ends of the hydraulic chambers are closed by the sprocket 1 and the front plate 3 and radial clearances are sealed by apex seals 9 to make the hydraulic chambers closed spaces.

FIG. 1 shows a state, in which a tapered portion at a tip end of a lock pin 10 is caused by a lock spring 11 to fit into a tapered hole of the sprocket 1 to inhibit relative rotation between the sprocket 1 and the cam shaft 6 to lock a phase angle while the tapered portion is pulled out from the tapered hole of the sprocket 1 against the bias of the lock spring 11 by hydraulic pressure supplied from a hydraulic pressure path (not shown) in a normal operating condition and a state, in which phase shift is made possible, is brought about. FIG. 3 and the following figures show this state and description is continued.

A cam shaft bearing 8 in FIGS. 1, 3, and 4 comprises a lower half being a part of a cylinder head and an upper half being a bearing cap and supports rotation of the cam shaft 6. The cam shaft is formed with two advanced angle hydraulic chamber communication paths 6*a* and two retarded angle hydraulic chamber communication paths 6*b*, which are made in parallel to an axis. One ends of the advanced angle hydraulic chamber communication paths 6*a* on the right in FIG. 1 are communicated to openings on the outer periphery of the cam shaft 6 by outer periphery opening advanced angle chamber passages 6*c* (see FIG. 3). The openings on the outer periphery are formed four at intervals of 90 degrees in a circumferential direction to correspond to the fact that the period of fluctuating torque exerted on the cam shaft 6 by reaction forces of valve springs is 90 degrees in the present embodiment directed to an inline four-cylinder type engine. Likewise, referring to FIG. 4, one ends of the retarded angle hydraulic chamber communication paths 6*b* are communicated to openings on the outer periphery of the cam shaft 6 by outer periphery opening retarded angle chamber passages 6*d* and the openings on the outer periphery are formed four at intervals of 90 degrees in the circumferential direction.

The other ends of the advanced angle hydraulic chamber communication paths 6*a* and the retarded angle hydraulic chamber communication paths 6*b* are respectively communicated to advanced angle hydraulic chamber passages 5*a* and retarded angle hydraulic chamber passages 5*b*, the advanced angle hydraulic chamber passages 5*a* and the retarded angle hydraulic chamber passages 5*b* being respectively communicated to the advanced angle hydraulic chambers and the retarded angle hydraulic chambers by branch passages (not shown). That is, as shown in FIG. 3, the advanced angle hydraulic chamber passages 5*a* through the pair of the advanced angle hydraulic chamber communication paths 6*a* branch into two in, for example, the vane 5 to be communicated through the respective branch passages to the four advanced angle hydraulic chambers shown in FIG. 2. As shown in FIG. 3, the cam shaft 6 is formed with four communication paths, that is, the pair of the advanced angle hydraulic chamber communication paths 6*a* and the pair of the retarded angle hydraulic chamber communication paths 6*b*, so that the cam shaft 6 is prevented from being decreased in strength due to formation of the communication paths (In a fundamental construction, eight communication paths are formed in the cam shaft 6 to lead to the respective hydraulic chambers, that is, eight of the advanced angle hydraulic chambers and the retarded angle hydraulic chambers shown in FIG. 2, but four communication paths are formed in the present embodiment in contrast to the fundamental construction). In the configuration of the communication paths shown in FIGS. 3 and 4, all the advanced angle hydraulic chambers are communicated to two adjacent ones of the openings on the outer periphery of the cam shaft in a III-III cross section of FIG. 3 and all the retarded angle hydraulic chambers are communicated to two adjacent ones of the openings on the outer periphery of the cam shaft in a IV-IV cross section of FIG. 4.

The cam shaft bearing 8 is formed in the III-III cross section of FIG. 3 with advanced angle occasion oil supply paths 8*a* and retarded angle occasion oil drain paths 8*b* and formed in the IV-IV cross section of FIG. 4 with advanced angle occasion oil drain paths 8*c* and retarded angle occasion oil supply paths 8*d*. The respective oil paths are formed pair by pair in positions opposed at 180 degrees but handled as one oil path system since they combine together forward as shown in FIG. 5 and the following drawings. An angle formed between the pair of the advanced angle occasion oil supply paths 8*a* and the pair of the retarded angle occasion oil drain paths 8*b* in the III-III cross section of FIG. 3 is set to 45 degrees or an angle close to 45 degrees+90 degrees=135 degrees. Likewise, an angle formed between the pair of the advanced angle occasion oil drain paths 8*c* and the pair of the retarded angle occasion oil supply paths 8*d* in the IV-IV cross section of FIG. 4 is also set to 45 degrees or an angle close to 45 degrees+90 degrees=135 degrees.

A rotated position of the cam shaft 6 in FIG. 3 is a rotated position, in which fluctuating torque exerted thereon has a peak in the direction of advanced angle. FIG. 3 shows that at that time the advanced angle hydraulic chamber communication paths 6*a* and the advanced angle occasion oil supply paths 8*a* are communicated to each other in two locations. This is enabled by regulating the positional relationship in a direction of rotation between four opened positions, in which the advanced angle hydraulic chamber communication paths 6*a* are opened through the outer periphery opening advanced angle chamber passages 6*c* to the outer peripheral surface of the cam shaft 6, and directions of four cams formed on the cam shaft 6. Consequently, all the advanced angle hydraulic chambers are communicated to the advanced angle occasion oil supply paths 8*a* in this timing.

A rotated position of the cam shaft 6 in FIG. 4 is a rotated position, in which fluctuating torque exerted thereon has a peak in the direction of advanced angle. FIG. 4 shows that at that time the retarded angle hydraulic chamber communication paths 6*b* and the advanced angle occasion oil drain paths 8*c* are communicated to each other in two locations. Consequently, all the retarded angle hydraulic chambers are communicated to the advanced angle occasion oil drain paths 8*c* in this timing.

FIGS. 5 and 6 show a state, in which the advanced angle occasion oil supply paths 8*a* and the advanced angle occasion oil drain paths 8*c* in FIGS. 3 and 4 are communicated to a hydraulic power source communication path 13*b* and a drain communication path 13*a*, respectively, by an electromagnetic valve 12. With the electromagnetic valve 12, a spool 12*b* axially driven by a solenoid 12*c* moves leftward in the drawings to be positioned relative to a body 12*a* to provide communication between the hydraulic power source communication path 13*b* and an advanced angle occasion oil supply communication path 13*e* in a control valve mount block 13 and to provide communication between the drain communication path 13*a* and an advanced angle occasion oil drain communication path 13*c*. The electromagnetic valve constitutes switchover means, which switches an oil path system of the communication paths 13*c* to 13*f* to a hydraulic power source and a drain, which are destinations of connection, and a cutoff state. The advanced angle occasion oil supply communication path 13*e* is communicated to the advanced angle occasion oil supply paths 8*a* and the advanced angle occasion oil drain communication path 13*c* is communicated to the advanced angle occasion oil drain paths 8*c*, respectively, through the oil paths shown in the drawing. In addition, while in FIG. 5 the advanced angle occasion oil supply communication path 13*e* and the advanced angle occasion oil supply path 8*a* (the advanced angle occasion oil supply path 8*a* positioned leftwardly downward in FIG. 5) of the cam shaft bearing 8 are communicated to each other, arrows midway in this communication are communicated to the advanced angle occasion oil supply path 8*a* shown rightwardly upward in FIG. 5. The pairs of the oil supply paths 8*a*, 8*d* and the oil drain paths 8*c* of the cam shaft bearing 8 are likewise in communication.

Since the rotated position of the cam shaft 6 in FIG. 5 is a rotated position, in which fluctuating torque has a peak in the direction of advanced angle in the same manner as in FIGS. 3 and 4. Eventually, all the advanced angle hydraulic chambers (see FIG. 2, in which a state of maximum retarded angle is shown) are communicated to the hydraulic power source communication path 13*b* through the advanced angle occasion oil supply paths 8*a* and all the retarded angle hydraulic chambers (see FIG. 2, in which a state of maximum retarded angle is shown) are communicated to the drain communication path 13*a* through the advanced angle occasion oil drain paths 8*c*. In a state shown in FIG. 5, hydraulic pressure is supplied to the advanced angle hydraulic chambers and both driving forces of the hydraulic pressure and fluctuating torque in the direction of advanced angle can achieve phase shift at high speed in the direction of advanced angle.

Figure 15:
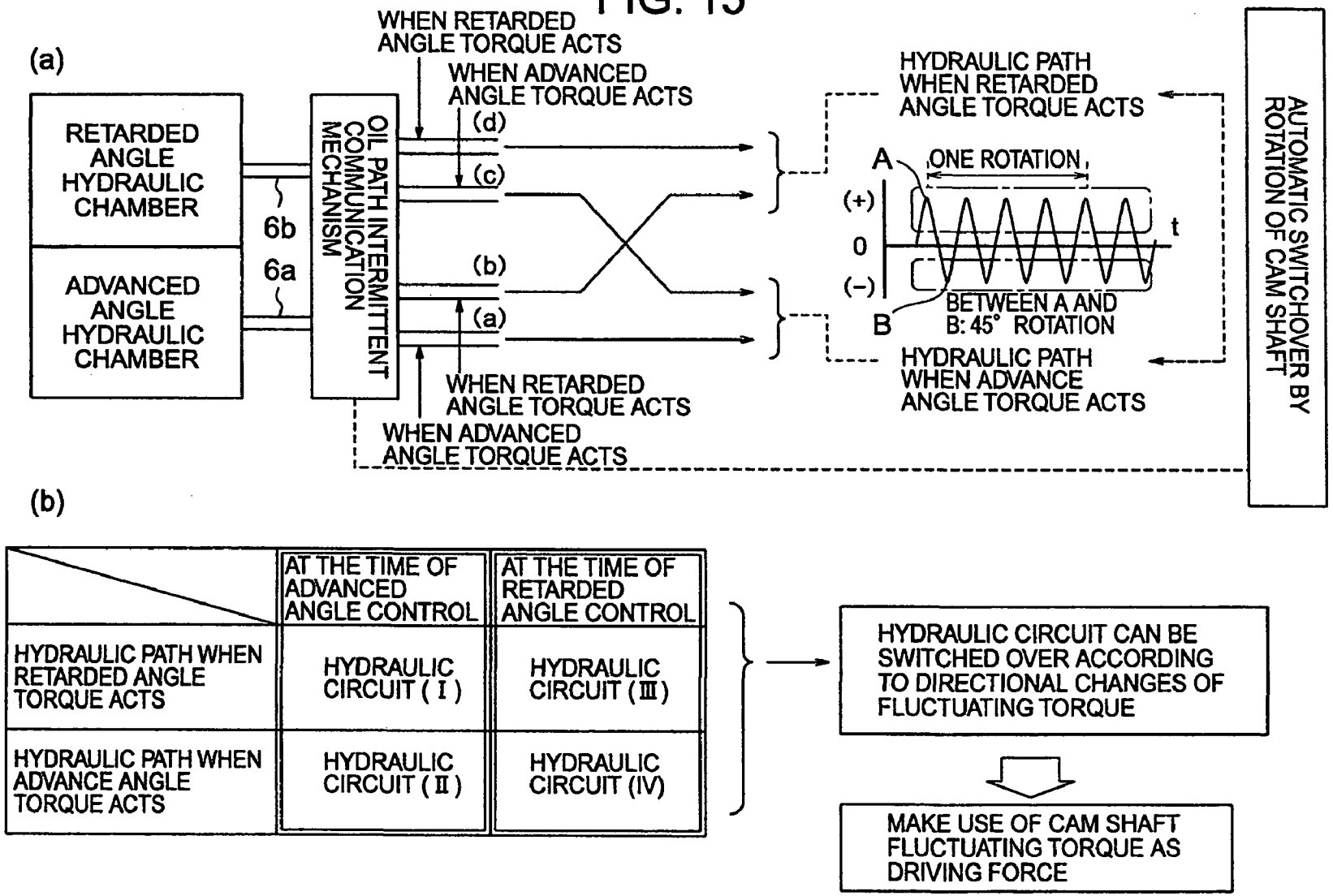
FIG. 15 is a view illustrating the fundamental function of a cam shaft phase adjusting apparatus according to a second embodiment of the invention.

On the other hand, a rotated position of the cam shaft 6 in FIG. 6 is turned about 45 degrees relative to that in FIG. 5 (an arrangement of the advanced angle hydraulic chamber communication paths 6*a* and the retarded angle hydraulic chamber communication paths 6*b* in FIG. 5 is turned 45 degrees rightward relative to that in FIG. 6) and is a rotated position, in which fluctuating torque has a peak in the direction of retarded angle (As described later, while fluctuating torque from the cam shaft is between a peak position of fluctuating torque in the direction of advanced angle and a peak position of fluctuating torque in the direction of retarded angle as shown in FIG. 15, the cam shaft rotates 45 degrees. A period between peak positions of fluctuating torque in the direction of advanced angle corresponds to 90 degree rotation of the cam shaft. A state shown in FIG. 6 is a state, in which control is exercised in an advanced angle mode.). In this state, all the advanced angle hydraulic chambers are cut off from the advanced angle occasion oil supply paths 8*a* and are communicated to the retarded angle occasion oil drain paths 8*b*, and all the retarded angle hydraulic chambers are cut off from the advanced angle occasion oil drain paths 8*c* and are communicated to the retarded angle occasion oil supply paths 8*d*. Also, the advanced angle occasion oil supply communication path 13*e* communicated to the hydraulic power source communication path 13*b* or the advanced angle occasion oil drain communication path 13*c* communicated to the drain communication path 13*a* by the electromagnetic valve 12 is not communicated to the retarded angle occasion oil supply paths 8*d* and the retarded angle occasion oil drain paths 8*b*. Accordingly, all the advanced angle hydraulic chambers and all the retarded angle hydraulic chambers make closed spaces isolated from an outside. Therefore, in a state in FIG. 6, driving is not made in the direction of retarded angle even when a large fluctuating torque in the direction of retarded angle acts.

Consequently, the cam shaft phase adjusting apparatus according to the first embodiment is driven by hydraulic pressure and fluctuating torque in the direction of advanced angle and reverse rotation can be prevented in a state, in which the electromagnetic valve 12 is controlled in the advanced angle mode as shown in FIGS. 5 and 6, so that phase shift can be achieved at high speed in the direction of advanced angle.

FIGS. 7 and 8 show a state, in which the retarded angle occasion oil supply paths 8*d* and the retarded angle occasion oil drain paths 8*b* in FIGS. 3 and 4 are communicated to the hydraulic power source communication path 13*b* and the drain communication path 13*a*, respectively, by the electromagnetic valve 12. With the electromagnetic valve 12, the spool 12*b* axially driven by the solenoid 12*c* moves rightward in the drawings to be positioned relative to the body 12*a* to provide communication between the hydraulic power source communication path 13*b* and a retarded angle occasion oil supply communication path 13*f* in the control valve mount block 13 and to provide communication between the drain communication path 13*a* and a retarded angle occasion oil drain communication path 13*d*. The retarded angle occasion oil supply communication path 13*f* is communicated to the retarded angle occasion oil supply paths 8*d* and the retarded angle occasion oil drain communication path 13*d* is communicated to the retarded angle occasion oil drain paths 8*b*, respectively, through the oil paths shown in the drawings.

A rotated position of the cam shaft 6 in FIG. 7 is a rotated position, in which fluctuating torque has a peak in the direction of advanced angle in the same manner as in FIGS. 3 and 4. In this state, all the advanced angle hydraulic chambers are cut off from the retarded angle occasion oil drain paths 8*b* and are communicated to the advanced angle occasion oil supply paths 8*a*, and all the retarded angle hydraulic chambers are cut off from the retarded angle occasion oil supply paths 8*d* and are communicated to the advanced angle occasion oil drain paths 8*c*. Also, the retarded angle occasion oil supply communication path 13*f* communicated to the hydraulic power source communication path 13*b* or the advanced angle occasion oil drain communication path 13*d* communicated to the drain communication path 13*a* by the electromagnetic valve 12 is not communicated to the advanced angle occasion oil supply paths 8*a* and the advanced angle occasion oil drain paths 8*c*. Accordingly, all the advanced angle hydraulic chambers and all the retarded angle hydraulic chambers make closed spaces isolated from an outside. Accordingly, in a state in FIG. 7, driving is not made in the direction of advanced angle even when a large fluctuating torque in the direction of advanced angle acts.

On the other hand, a rotated position of the cam shaft 6 in FIG. 8 is turned about 45 degrees relative to that in FIG. 7 and is a rotated position, in which fluctuating torque has a peak in the direction of retarded angle. In this state, all the advanced angle hydraulic chambers are communicated to the retarded angle occasion oil drain paths 8*b* and all the retarded angle hydraulic chambers are communicated to the retarded angle occasion oil supply paths 8*d*. Therefore, all the retarded angle hydraulic chambers are communicated to the hydraulic power source communication path 13*b* and all the advanced angle hydraulic chambers are communicated to the drain communication path 13*a*. In a state in FIG. 8, hydraulic pressure is supplied to the retarded angle hydraulic chambers and both driving forces of the hydraulic pressure and fluctuating torque in the direction of retarded angle can achieve phase shift at high speed in the direction of retarded angle.

Consequently, the cam shaft phase adjusting apparatus according to the first embodiment is driven by hydraulic pressure and fluctuating torque in the direction of retarded angle and reverse rotation also can be prevented in a state, in which the electromagnetic valve 12 is controlled in the retarded angle mode as shown in FIGS. 7 and 8, so that phase shift can be achieved at high speed in the direction of retarded angle.

As described above, it is possible according to the first embodiment to perform phase shift of the cam shaft phase adjusting apparatus at high speed both in the direction of advanced angle and in the direction of retarded angle. That is, at the time of low speed operation, in which hydraulic pressure is low and a reverse rotation phenomenon is generated, the cam shaft phase adjusting apparatus can be made highly responsive as compared with a conventional oil supply construction, in which hydraulic pressure is continuously supplied.

In addition, in FIGS. 5 to 8, an advanced angle chamber oil path system intermediate shut-off valve 14 is mounted between an advanced angle chamber oil path system, which connects between the advanced angle occasion oil supply paths 8*a* and the advanced angle occasion oil supply communication path 13*e*, and an advanced angle chamber oil path system, which connects between the retarded angle occasion oil drain paths 8*b* and the retarded angle occasion oil drain communication path 13*d*, and a retarded angle chamber oil path system intermediate shut-off valve 15 is mounted between a retarded angle chamber oil path system, which connects between the advanced angle occasion oil drain paths 8*c* and the advanced angle occasion oil drain communication path 13*c*, and a retarded angle chamber oil path system, which connects between the retarded angle occasion oil supply paths 8*d* and the retarded angle occasion oil supply communication path 13*f*. As described above, when high responsiveness is realized by carrying out phase shift with hydraulic pressure and fluctuating torque and preventing reverse rotation by fluctuating torque in a reverse direction (Since the advanced angle chambers and the retarded angle chambers are made closed spaces for fluctuating torque in a reverse direction to a direction (a direction of advanced angle mode or retarded angle mode), in which it is desirable to carry out phase shift, the cam shaft will not rotate in the reverse direction to that direction, in which it is desirable to carry out phase shift, so that phase shift can be carried out in that direction, in which it is desirable to carry out phase shift), both the advanced angle chamber oil path system intermediate shut-off valve 14 and the retarded angle chamber oil path system intermediate shut-off valve 15 are controlled to "closed" and two advanced angle chamber oil path systems are made oil path systems, which are isolated from and independent of each other, and two retarded angle chamber oil path systems are made oil path systems, which are isolated from and independent of each other.

In FIGS. 9 and 10, the electromagnetic valve 12 is controlled so that the spool 12*b* is positioned in a neutral position.

In this state, the hydraulic power source communication path 13*b* of the control valve mount block 13 is cut off from both the advanced angle occasion oil supply communication path 13*e* and the retarded angle occasion oil supply communication path 13*f*, and the drain communication path 13*a* is cut off from both the retarded angle occasion oil drain communication path 13*d* and the advanced angle occasion oil drain communication path 13*c*. Irrespective of a rotated position of the cam shaft 6, that is, in both FIGS. 9 and 10, all the advanced angle hydraulic chambers and all the retarded angle hydraulic chambers are made closed spaces, which are isolated from an outside. Accordingly, by controlling the electromagnetic valve 12 in a stationary mode in this manner, the cam shaft phase adjusting apparatus can be fixed in a predetermined phase without being moved by both fluctuating torque in the direction of advanced angle and fluctuating torque in the direction of retarded angle.

FIGS. 11 and 12 show a state, in which both the advanced angle chamber oil path system intermediate shut-off valve 14 and the retarded angle chamber oil path system intermediate shut-off valve 15 in FIGS. 5 and 6 are controlled to "opened" (communication is provided both between the plurality of advanced angle chamber oil path systems and between the plurality of retarded angle chamber oil path systems). The electromagnetic valve 12 is controlled in the advanced angle mode. In this state, it is possible to communicate the advanced angle hydraulic chambers to the hydraulic power source communication path 13*b* and communicate the retarded angle hydraulic chambers to the drain communication path 13*a* at all times irrespective of rotated positions of the cam shaft 6 (In both a rotated position of the cam shaft in FIG. 11 and a rotated position of the cam shaft in FIG. 12, the advanced angle hydraulic chambers are connected to the hydraulic power source communication path 13*b* and the retarded angle hydraulic chambers are connected to the drain communication path 13*a* to establish a continuous oil supply condition in the advanced angle mode). In a rotated position in FIG. 11, in which fluctuating torque in the direction of advanced angle acts, the advanced angle hydraulic chambers are communicated to the hydraulic power source communication path 13*b* through the advanced angle occasion oil supply paths 8*a* and the advanced angle occasion oil supply communication path 13*e*, and the retarded angle hydraulic chambers are communicated to the drain communication path 13*a* through the advanced angle occasion oil drain paths 8*c* and the advanced angle occasion oil drain communication path 13*c*.

Also, in a rotated position in FIG. 12, in which fluctuating torque in the direction of retarded angle acts, the advanced angle hydraulic chambers are communicated to the hydraulic power source communication path 13*b* through the retarded angle occasion oil drain paths 8*b*, the advanced angle chamber oil path system intermediate shut-off valve 14, and the advanced angle occasion oil supply communication path 13*e*, and the retarded angle hydraulic chambers are communicated to the drain communication path 13*a* through the retarded angle occasion oil supply paths 8*d*, the retarded angle chamber oil path system intermediate shut-off valve 15, and the advanced angle occasion oil drain communication path 13*c*. At this time, there comes out a state, in which irrespective of rotated positions of the cam shaft 6, hydraulic pressure is supplied to the advanced angle hydraulic chambers from the hydraulic power source and an oil is discharged to a drain from the retarded angle hydraulic chambers at all times, so that a conventional construction is provided, in which an oil is supplied continuously at the time of advanced angle.

FIGS. 13 and 14 show a state, in which both the advanced angle chamber oil path system intermediate shut-off valve 14 and the retarded angle chamber oil path system intermediate shut-off valve 15 in FIGS. 7 and 8 are controlled to "opened". The electromagnetic valve 12 is controlled in a retarded angle mode. In this state, it is possible to communicate the advanced angle hydraulic chambers to the drain communication path 13*a* and communicate the retarded angle hydraulic chambers to the hydraulic power source communication path 13*b* at all times irrespective of rotated positions of the cam shaft 6. In a rotated position in FIG. 13, in which fluctuating torque in the direction of advanced angle acts, the advanced angle hydraulic chambers are communicated to the drain communication path 13*a* through the advanced angle occasion oil supply paths 8*a*, the, advanced angle chamber oil path system intermediate shut-off valve 14, and the retarded angle occasion oil drain communication path 13*d*, and the retarded angle hydraulic chambers are communicated to the hydraulic power source communication path 13*b* through the advanced angle occasion oil drain paths 8*c*, the retarded angle chamber oil path system intermediate shut-off valve 15, and the retarded angle occasion oil supply communication path 13*f*. In a rotated position in FIG. 14, in which fluctuating torque in the direction of retarded angle acts, the advanced angle hydraulic chambers are communicated to the drain communication path 13*a* through the retarded angle occasion oil drain paths 8*b* and the retarded angle occasion oil drain communication path 13*d*, and the retarded angle hydraulic chambers are communicated to the hydraulic power source communication path 13*b* through the retarded angle occasion oil supply paths 8*d* and the retarded angle occasion oil supply communication path 13*f*. At this time, there comes out a state, in which irrespective of rotated positions of the cam shaft 6, hydraulic pressure is supplied to the retarded angle hydraulic chambers from the hydraulic power source and an oil is discharged to the drain from the advanced angle hydraulic chambers at all times, so that a conventional construction is provided, in which an oil is supplied continuously at the time of retarded angle.

Generally, when an engine is increased in rotating speed, hydraulic pressure supplied to the cam shaft phase adjusting apparatus becomes sufficiently high, and a torque component in a reverse direction to that direction, in which it is desirable to carry out phase shift, decreases in a composed torque of fluctuating torque exerted on the cam shaft by reaction forces of the valve springs and drive torque generated by hydraulic pressure. Also, when fluctuating torque becomes high in frequency, inertial resistances of a fluidic system and moving members increase. Accordingly, the cam shaft phase adjusting apparatus is going to continue phase shift in that direction, in which phase shift is controlled from an outside, so that a reverse rotation phenomenon (a phenomenon of phase shift by fluctuating torque in a direction opposite to a direction, in which it is desirable to carry out phase shift) as at low speed with low hydraulic pressure) is not generated.

When oil is intermittently supplied and drained as shown in FIGS. 5 to 8 in that condition, in which such reverse rotation phenomenon is not generated, flow of the oil is cut off in the midst of phase shift in an intended direction and brake is applied, so that conversely response speed is reduced. Also, the flow passages are forcedly cut off to stop flow of oil in a moment whereby a water hammer phenomenon is generated to cause vibration and noise. According to the function of the first embodiment shown in FIGS. 11 to 14, in that condition, in which reverse rotation is not generated at the time of phase shift, intermittent supply and discharge of oil are cancelled and the same, continuous supply and discharge of oil as conventional one can be performed, so that it is possible to avoid a disadvantage such as a decrease in speed of response, a water hammer phenomenon, etc. in high speed operation.

In this manner, with the construction according to the first embodiment of the invention, it is possible to provide a cam shaft phase adjusting apparatus, which is high in practicability and does not generate a disadvantage such as a decrease in speed of response and a water hammer phenomenon in high speed operation while realizing a high responsiveness in low speed operation, in which speed of phase shift is short.

Subsequently, a cam shaft phase adjusting apparatus for internal combustion engine, according to a second embodiment of the invention, will be described citing a fundamental function, a configuration example, and a control example of the cam shaft phase adjusting apparatus.

Figure 16:
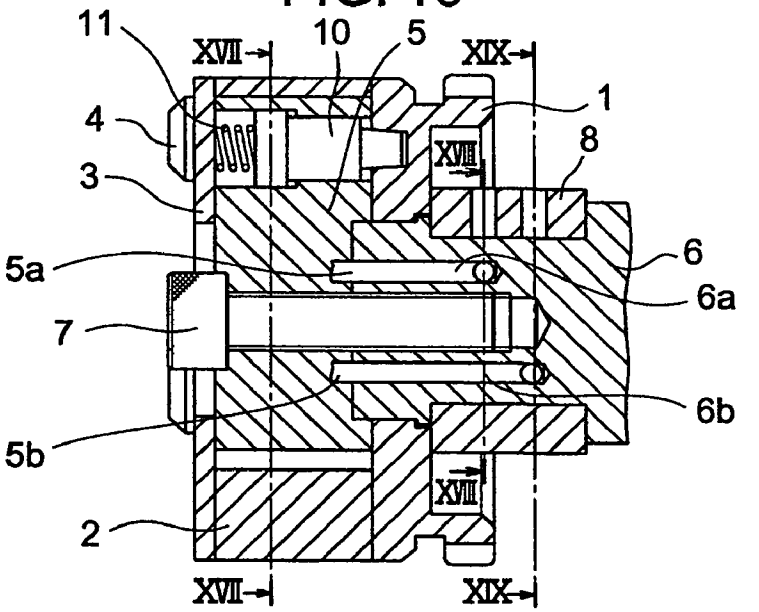
FIG. 16 is a side, cross sectional view showing a cam shaft phase adjusting apparatus for internal combustion engines according to a second embodiment of the invention and taken along the line XVI-XVI in FIG. 17.
Figure 19:
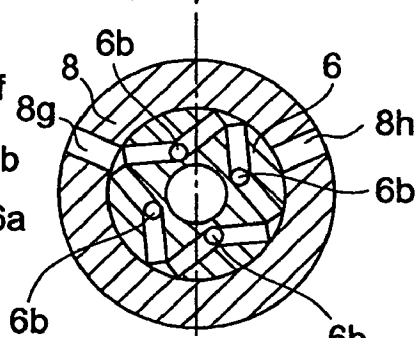
FIG. 19 is a cross sectional view showing hydraulic pressure paths to retarded angle hydraulic chambers in the cam shaft phase adjusting apparatus according to the second embodiment and taken along the line XIX-XIX in FIG. 16.
Figure 18:
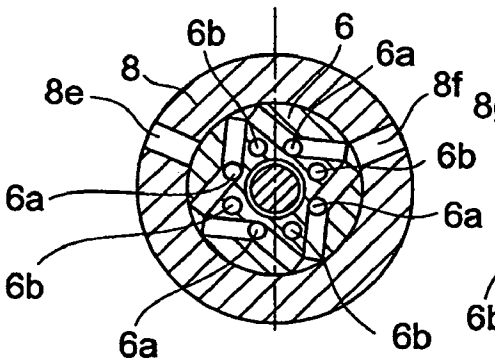
FIG. 18 is a cross sectional view showing hydraulic pressure paths to advanced angle hydraulic chambers in the cam shaft phase adjusting apparatus according to the second embodiment and taken along the line XVIII-XVIII in FIG. 16.
Figure 17:
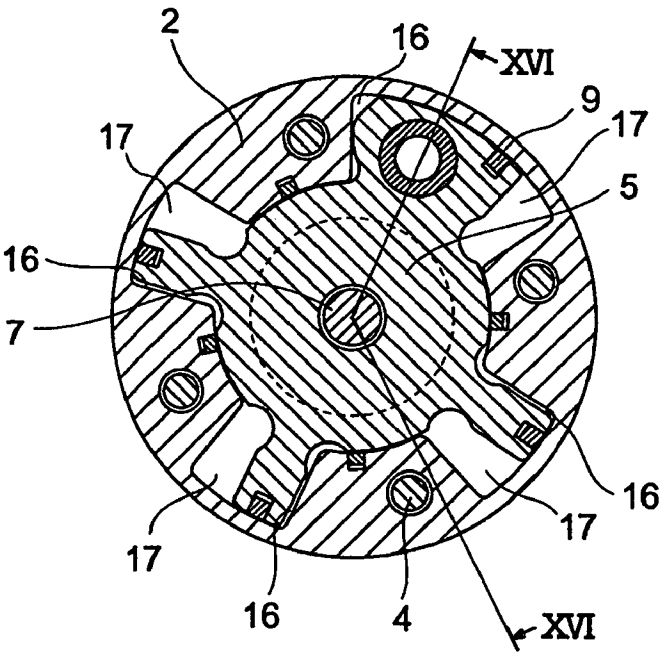
FIG. 17 is a cross sectional view showing the cam shaft phase adjusting apparatus according to the second embodiment and taken along the line XVII-XVII in FIG. 16.
Figure 20:
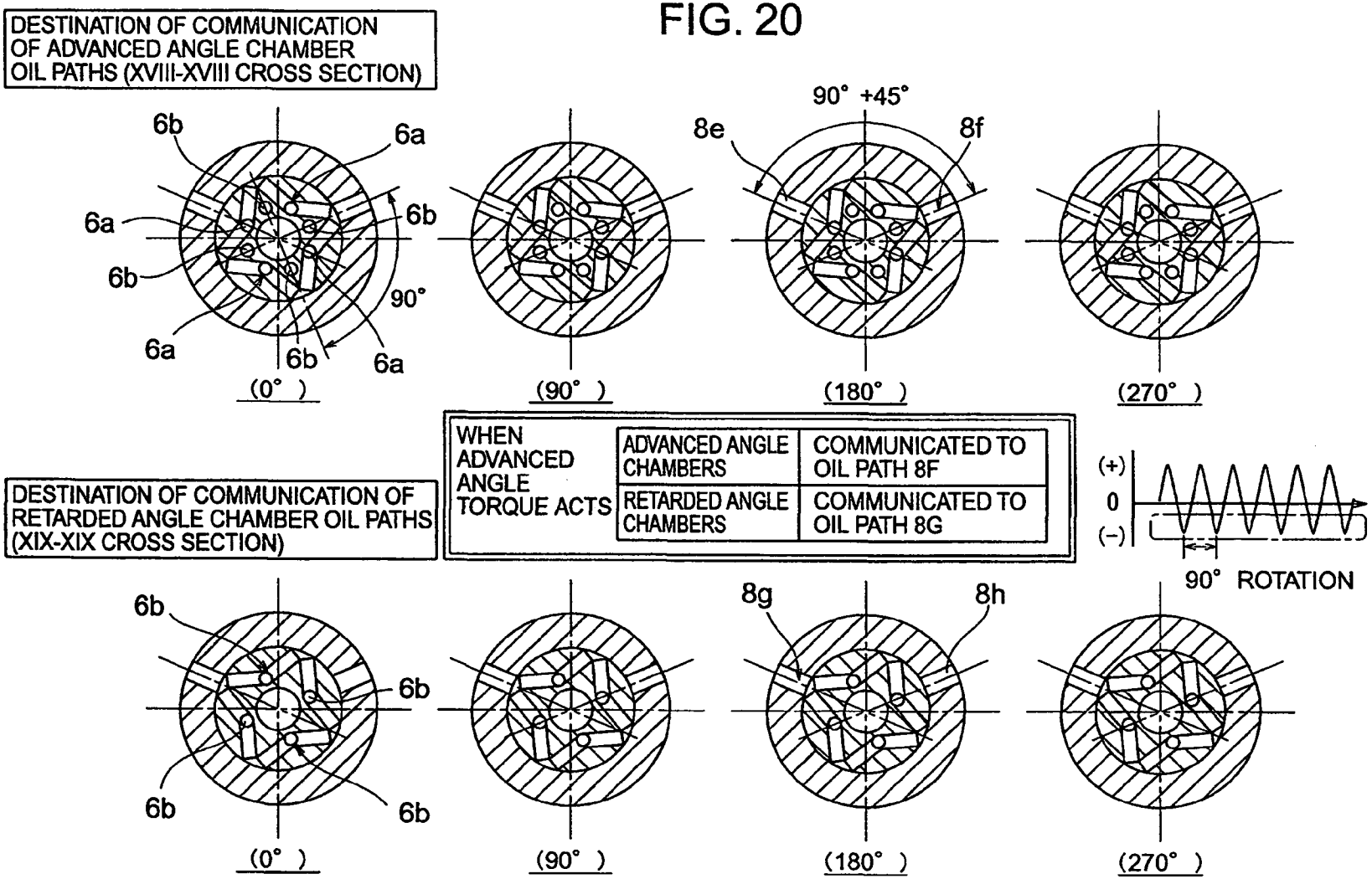
FIG. 20 is a view illustrating an oil path communication when an advanced angle torque acts on a cam shaft in the cam shaft phase adjusting apparatus according to the second embodiment.
Figure 21:
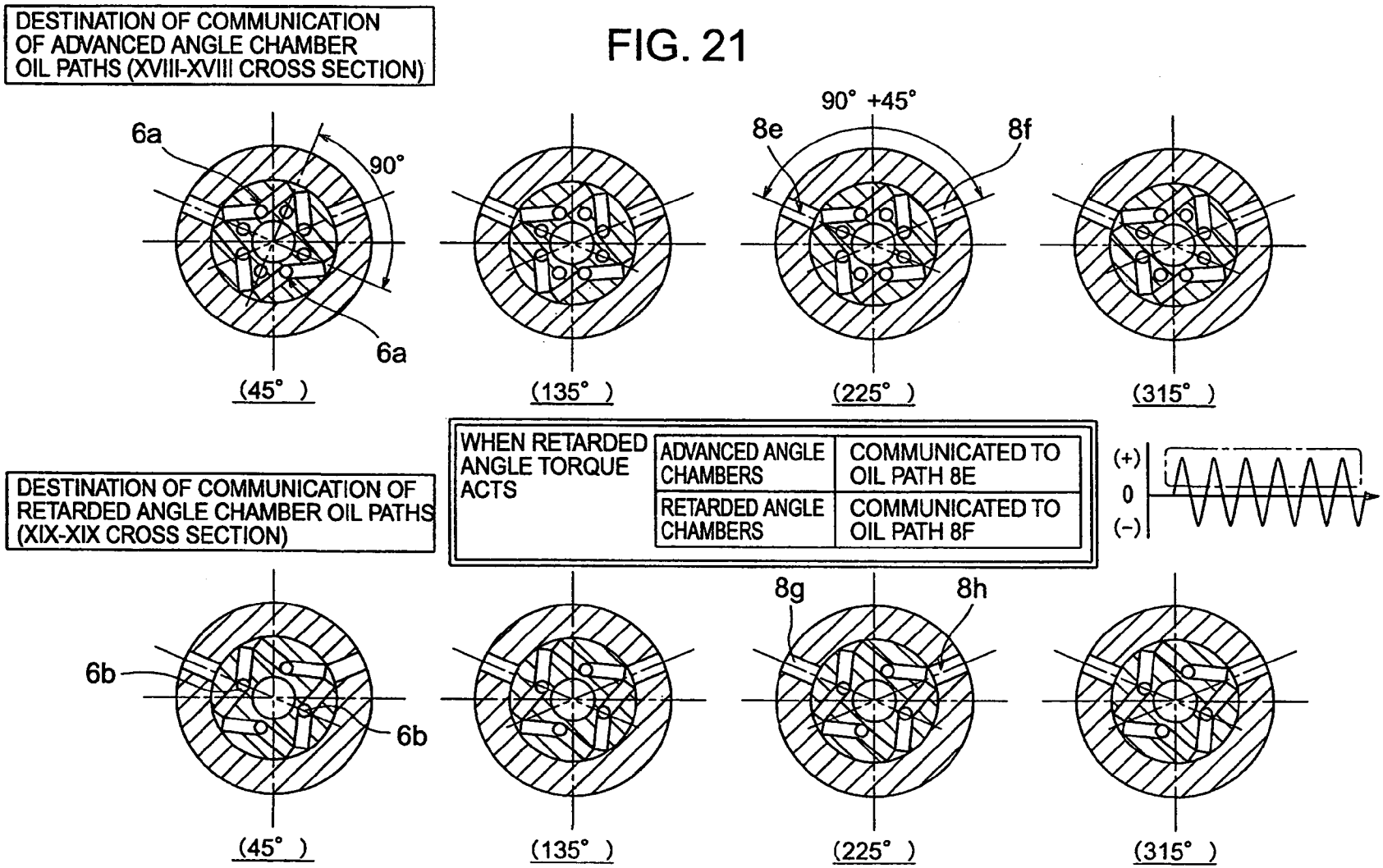
FIG. 21 is a view illustrating an oil path communication when a retarded angle torque acts on the cam shaft in the cam shaft phase adjusting apparatus according to the second embodiment.
Figure 22:
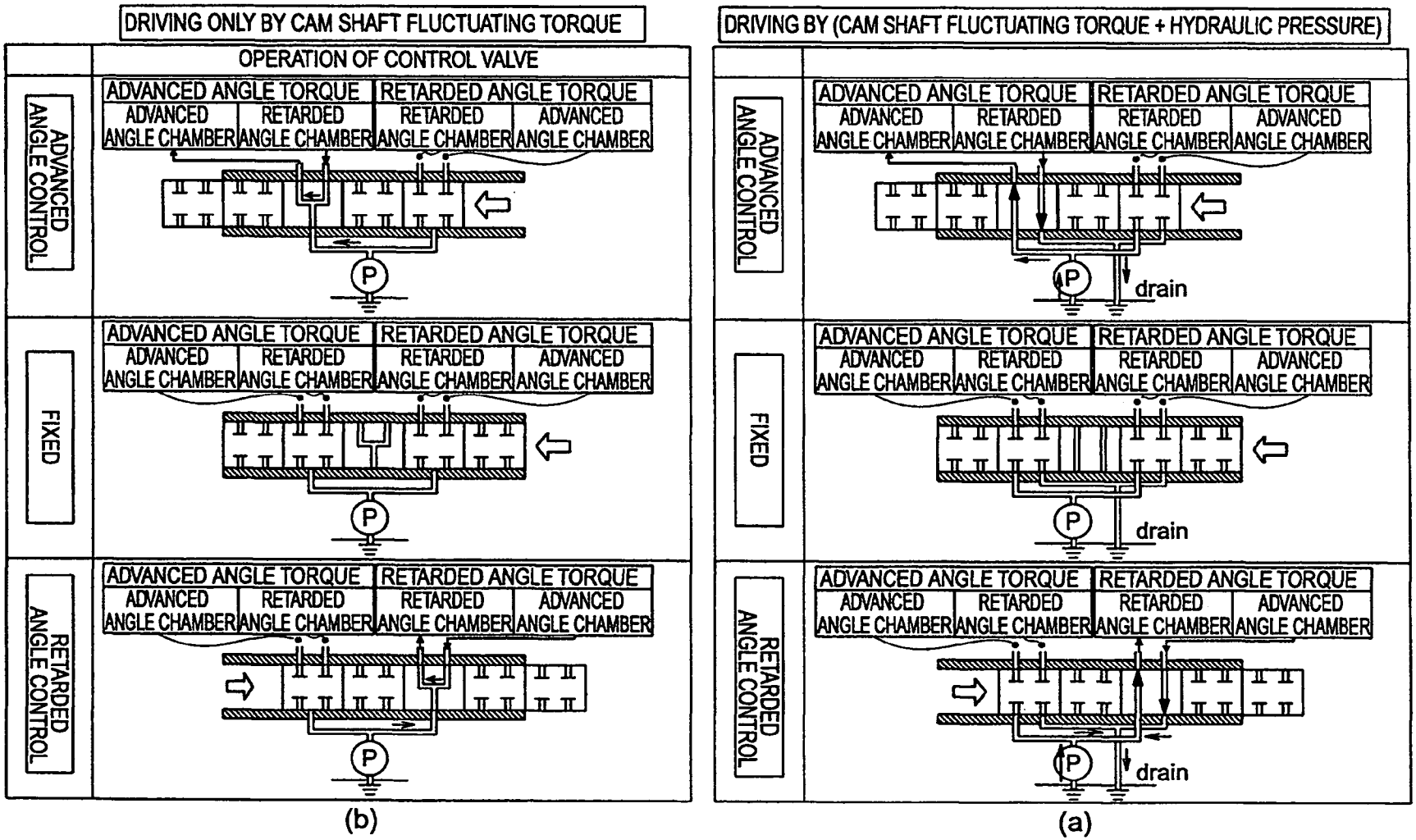
FIG. 22 is a view illustrating a configuration of control on advanced angle chambers and retarded angle chambers in driving only by a cam shaft fluctuating torque and driving by (cam shaft fluctuating torque+hydraulic pressure) in the cam shaft phase adjusting apparatus according to the second embodiment in the case where advanced angle control and retarded angle control are exercised on engine intake and exhaust valves.

FIG. 15 is a view illustrating the fundamental function of a cam shaft phase adjusting apparatus according to a second embodiment of the invention. FIG. 16 is a side, cross sectional view showing a cam shaft phase adjusting apparatus for internal combustion engines according to a second embodiment of the invention and taken along the line XVI-XVI in FIG. 17. FIG. 17 is a cross sectional view showing the cam shaft phase adjusting apparatus according to the second embodiment and taken along the line XVII-XVII in FIG. 16. FIG. 18 is a cross sectional view showing hydraulic pressure paths to advanced angle hydraulic chambers in the cam shaft phase adjusting apparatus according to the second embodiment and taken along the line XVIII-XVIII in FIG. 16. FIG. 19 is a cross sectional view showing hydraulic pressure paths to retarded angle hydraulic chambers in the cam shaft phase adjusting apparatus according to the second embodiment and taken along the line XIX-XIX in FIG. 16. FIG. 20 is a view illustrating an oil path communication when an advanced angle torque acts on a cam shaft in the cam shaft phase adjusting apparatus according to the second embodiment. FIG. 21 is a view illustrating an oil path communication when a retarded angle torque acts on the cam shaft in the cam shaft phase adjusting apparatus according to the second embodiment. FIG. 22 is a view illustrating a configuration of control on advanced angle chambers and retarded angle chambers in driving only by a cam shaft fluctuating torque and driving by (cam shaft fluctuating torque+hydraulic pressure) in the cam shaft phase adjusting apparatus according to the second embodiment in the case where advanced angle control and retarded angle control are exercised on engine intake and exhaust valves;

FIG. 16 is a view corresponding to FIG. 1. FIG. 17 is a view taken along line XVII-XVII in FIG. 16 and showing the construction of advanced angle hydraulic chambers and retarded angle hydraulic chambers, which are defined by a body 2 and a vane 5, and corresponds to FIG. 2. FIGS. 18 and 19 are cross sectional views respectively taken along lines XVIII-XVIII and XIX-XIX in FIG. 16, and respectively correspond to FIGS. 3 and 4. Oil paths 8*e*, 8*f*, 8*g*, and 8*h* are formed in a bearing cap of a cam shaft bearing 8. Four advanced angle chamber oil paths 6*a* and four retarded angle chamber oil paths 6*b* are arranged along a center bolt 7 to correspond to four pairs of advanced angle hydraulic chambers 16 and retarded angle hydraulic chambers 17 (see FIG. 17). As seen from FIG. 16, the oil paths 8*e*, 8*f* and the oil paths 8*h* and 8*g* are formed in different positions along the cam shaft bearing. An oil path intermittent communication mechanism is constituted mainly by a cam shaft 6, the cam shaft bearing 8, the oil paths 8*e* to 8*h*, the advanced angle chamber oil paths 6*a*, and the retarded angle chamber oil paths 6*b*.

FIG. 15(*a*) shows a manner of operation, in which oil is supplied to and discharged from the retarded angle hydraulic chambers 17 and the advanced angle hydraulic chambers 16 in the case where fluctuating torque acting on the cam shaft 6 is a retarded angle torque and in the case where fluctuating torque is an advanced angle torque. Taking a cam shaft phase adjusting apparatus of an inline four-cylinder type engine as an example, it is shown in FIG. 15 that a rotated position, in which a peak is present in fluctuating torque in a direction of retarded angle, appears four times repeatedly per one rotation of the cam shaft, and an interval between+peaks in retarded angle torque corresponds to rotation of the cam shaft over 90 degrees. An interval between+peak (peak of retarded angle torque) and−peak (peak of advanced angle torque) in the waveform shown corresponds to rotation of the cam shaft over 45 degrees. Four hydraulic circuits of the oil path intermittent communication mechanism as shown correspond to the communication paths 13*c*, 13*d*, 13*e*, 13*f* shown in FIGS. 5 and 6.

When an advanced angle torque acts as the fluctuating torque on the cam shaft 6, the cam shaft 6 performs phase shift in a direction of advanced angle, and as illustrated in FIGS. 5 and 6, when control in an advanced angle mode is desired and an advanced angle torque acts on the cam shaft, the oil paths 8*e* to 8*h* are communicated to the advanced angle hydraulic chambers 16 (oil supply) and the retarded angle hydraulic chambers 17 (oil drain). When the cam shaft 6 rotates 45 degrees and a retarded angle torque acts, the advanced angle chambers 16 and the retarded angle chambers 17 are not communicated to the oil paths 8*e* to 8*h*. After all, formation of the oil paths to the advanced angle hydraulic chambers 16 and the retarded angle hydraulic chambers 17 leads to oil path intermittent communication, so that phase shift of the cam shaft 6 is performed making use of only a mode, in which phase shift is desired, and fluctuating torque in the associated direction.

Referring to FIG. 15(*a*), when an advanced angle torque acts, a hydraulic circuit (a) communicates to the advanced angle hydraulic chambers 16 and when a retarded angle torque acts, a hydraulic circuit (b) communicates to the advanced angle hydraulic chambers 16, and when a retarded angle torque acts, a hydraulic circuit (c) communicates to the retarded angle hydraulic chamber 17 and when an advanced angle torque acts, a hydraulic circuit (d) communicates to the retarded angle hydraulic chamber 17, whereby a hydraulic path when an advanced angle torque acts is switched over by rotation of the cam shaft 6 so that the hydraulic circuits (a) and (d) are communicated to each other, and a hydraulic path when a retarded angle torque acts is switched over by rotation of the cam shaft 6 so that the hydraulic circuits (b) and (c) are communicated to each other. That is, two hydraulic circuits (a) and (b) are repeatedly communicated to and cut off from the advanced angle hydraulic chambers 16 according to rotation of the cam shaft 6. The same may be said of two hydraulic circuits (c) and (d) for the retarded angle hydraulic chambers 17. In this manner, one of features of the invention resides in that the hydraulic circuits can be switched over between communication and cutoff according to rotation of the cam shaft 6.

FIG. 15(*b*) shows hydraulic paths when an advanced angle torque acts and when a retarded angle torque acts, respectively, at the time of advanced angle control (advanced angle mode) and at the time of retarded angle control (mode). A hydraulic circuit (I) corresponds to the path shown in FIG. 6, in which a retarded angle torque acts at the time of advanced angle control and the advanced angle hydraulic chambers 16 and the retarded angle hydraulic chambers 17 are made closed spaces and the fluctuating torque is cut off. A hydraulic circuit (II) corresponds to the path shown in FIG. 5, in which an advanced angle torque acts at the time of advanced angle control and the fluctuating torque can be made use of as a driving force in a direction of advanced angle (hydraulic pressure can also be made use of as a driving force). Also, a hydraulic circuit (III) corresponds to the path shown in FIG. 8, in which a retarded angle torque acts at the time of retarded angle control and the fluctuating torque can be made use of as a driving force in a direction of retarded angle (hydraulic pressure can also be made use of as a driving force). A hydraulic circuit (IV) corresponds to the path shown in FIG. 7, in which an advanced angle torque acts at the time of retarded angle control and the advanced angle hydraulic chambers 16 and the retarded angle hydraulic chambers 17 are made closed spaces and the fluctuating torque is cut off.

In this manner, the embodiment provides that construction, in which a hydraulic pressure circuit is switched over according to those directional changes in advanced angle and retarded angle of the fluctuating torque from the cam shaft 6, which result from rotation of the cam shaft 6. The construction makes use of a cam shaft fluctuating torque as a driving force for the cam shaft phase adjusting apparatus, in other words, makes use of, as a driving force for phase shift, only the fluctuating torque in a direction corresponding to an associated mode in the case where an advanced angle mode or a retarded angle mode is set, and one of features of the invention resides in a manner, in which such driving force is made use of.

FIG. 20 is a view showing a state of communication between the advanced angle chamber oil paths 6*a* (see FIG. 18) and the retarded angle chamber oil paths 6*b* (see FIG. 19) when an advanced angle torque acts. Since the advanced angle torque exhibits a peak in the fluctuating torque every 90 degree rotation of the cam shaft 6, a state of oil path communication every 90 degree rotation is shown. As shown in FIG. 20, four advanced angle chamber oil paths 6*a* communicated to four advanced angle chambers 16 are communicated to the oil path 8*f* (oil is supplied in the advanced angle mode) in peak positions of the advanced angle torque at 0°, 90°, 180°, and 270°. Further, four retarded angle chamber oil paths 6*b* communicated to four retarded angle chambers 17 are communicated to the oil path 8*g* (oil is discharged in the advanced angle mode) in peak positions of the advanced angle torque at 0°, 90°, 180°, and 270°.

FIG. 21 is a view showing a state of communication between the advanced angle chamber oil paths 6*a* (see FIG. 18 and the retarded angle chamber oil paths 6*b* (see FIG. 19) when a retarded angle torque acts. Since the retarded angle torque exhibits a peak in the fluctuating torque every 90 degree rotation of the cam shaft 6, a state of oil path communication every 90 degree rotation is shown. As shown in FIG. 21, four advanced angle chamber oil paths 6*a* communicated to four advanced angle chambers 16 are communicated to the oil path 8*e* (oil is supplied in the retarded angle mode) in peak positions of the retarded angle torque at 45°, 135°, 225°, and 315°. Further, four retarded angle chamber oil paths 6*b* communicated to four retarded angle chambers 17 are communicated to the oil path 8*h* (oil is discharged in the retarded angle mode) in peak positions of retarded angle torque at 45°, 135°, 225°, and 315°.

FIG. 22 illustrates a system (see FIG. 22(*a*)), in which the cam shaft is driven by (cam shaft fluctuating torque+hydraulic pressure), and a system (see FIG. 22(*b*)), in which the cam shaft is driven only by cam shaft fluctuating torque, in the case where the electromagnetic valve is actuated in advanced angle mode (control), retarded angle mode (control), or a stationary mode (control to fix to a predetermined phase without being moved by the fluctuating torque) at the time of phase shift of the cam shaft.

As shown in FIG. 22(*a*), the electromagnetic valve is moved leftward as shown in the drawing in order to bring about the advanced angle mode (a state, in which phase shift is desired in the advanced angle direction). In the case where fluctuating torque on the cam shaft is an advanced angle torque, hydraulic pressure from the hydraulic power source P is communicated to the advanced angle chambers 16 and the retarded angle chambers 17 are communicated to the drain through the electromagnetic valve. Accordingly, hydraulic driving is added to the advanced angle torque as the fluctuating torque to cause phase shift of the cam shaft. Here, in the case where the fluctuating torque on the cam shaft is a retarded angle torque (see FIG. 15(*a*) with respect to the fact that the retarded angle torque and the advanced angle torque are periodically repeated with rotation of the cam shaft), non-communication caused by the electromagnetic valve makes the advanced angle chambers 16 and the retarded angle chambers 17 closed spaces, so that the retarded angle torque as the fluctuating torque neither makes the vane 5 connected to the cam shaft 6 movable nor serves as phase shift of the cam shaft 6.

Also, the electromagnetic valve is moved rightward as shown in the drawing in order to bring about the retarded angle mode (a state, in which phase shift is desired in the retarded angle direction). In the case where the fluctuating torque on the cam shaft is the retarded angle torque, hydraulic pressure from the hydraulic power source P is communicated to the retarded angle chambers 17 and the advanced angle chambers 16 are communicated to the drain through the electromagnetic valve. Accordingly, hydraulic driving is added to the retarded angle torque as the fluctuating torque to cause phase shift of the cam shaft 6. Here, in the case where the fluctuating torque on the cam shaft 6 is the advanced angle torque, non-communication caused by the electromagnetic valve makes the retarded angle chambers 17 and the advanced angle chambers 16 closed spaces, so that the advanced angle torque neither makes the vane 5 connected to the cam shaft 6 movable nor serves as phase shift of the cam shaft 6. Also, the electromagnetic valve is moved to a neutral position as shown in the drawing in order to bring about the stationary mode. Even in the case where the fluctuating torque on the cam shaft 6 is the advanced angle torque or the retarded angle torque, non-communication caused by the electromagnetic valve makes the retarded angle chambers 17 and the advanced angle chambers 16 closed spaces, so that the advanced angle torque and the retarded angle torque do not make the vane 5 connected to the cam shaft 6 movable but fix phase shift of the cam shaft 6 to a predetermined phase.

Subsequently, a system, in which the cam shaft 6 is driven only by the cam shaft fluctuating torque, will be described with reference to FIG. 22(*b*). The system in FIG. 19(*b*) is different from the system in FIG. 19(*a*) in that any drain communication path is not provided, the hydraulic power source P does not drive the advanced angle chambers 16 and the retarded angle chambers 17 hydraulically but replenishes these chambers with oil, and the electromagnetic valve is different from the latter in communication path configuration. As shown in an upper part of FIG. 22(*b*), the electromagnetic valve is moved leftward in order to bring about the advanced angle mode. In the case where the fluctuating torque on the cam shaft 6 is the advanced angle torque, the vane 5 is rotated clockwise as seen from FIGS. 17 and 20 and the advanced angle chambers 16 and the retarded angle chambers 17 are communicated to each other by the communication path of the electromagnetic valve, so that oil flows into the advanced angle chambers 16 from the retarded angle chambers 17 so as to enlarge the advanced angle chambers 16, that is, advances in the direction of advanced angle. Here, in the case where the fluctuating torque on the cam shaft 6 is the retarded angle torque (see FIG. 15(*a*) with respect to the fact that the retarded angle torque and the advanced angle torque are periodically repeated with rotation of the cam shaft 6), non-communication caused by the electromagnetic valve makes the retarded angle chambers 17 and the advanced angle chambers 16 closed spaces, so that the retarded angle torque neither makes the vane 5 connected to the cam shaft 6 movable nor serves as phase shift of the cam shaft 6.

As shown in a lower part of FIG. 22(*b*), the electromagnetic valve is moved rightward in order to bring about the retarded angle mode. In the case where the fluctuating torque on the cam shaft 6 is the retarded angle torque, the vane 5 is rotated counterclockwise as seen from FIGS. 17 and 21 and the advanced angle chambers 16 and the retarded angle chambers 17 are communicated to each other by the communication path of the electromagnetic valve, so that oil flows into the retarded angle chambers 17 from the advanced angle chambers 16 so as to enlarge the retarded angle chambers 17, that is, advances in the direction of retarded angle. Here, in the case where the fluctuating torque on the cam shaft 6 is the advanced angle torque, non-communication caused by the electromagnetic valve makes the retarded angle chambers 17 and the advanced angle chambers 16 closed spaces, so that the advanced angle torque neither makes the vane 5 connected to the cam shaft 6 movable nor serves as phase shift of the cam shaft 6. Also, as shown in a middle part of FIG. 22(*b*), the electromagnetic valve is moved to a neutral position in order to bring about the stationary mode. Even in the case where the fluctuating torque on the cam shaft 6 is the advanced angle torque or the retarded angle torque, non-communication caused by the electromagnetic valve makes the retarded angle chambers 17 and the advanced angle chambers 16 closed spaces, so that the advanced angle torque and the retarded angle torque do not make the vane 5 connected to the cam shaft 6 movable but fix phase shift of the cam shaft 6 to a predetermined phase.

Examining the configuration of oil path communication in the upper and lower parts in FIG. 22(*b*) again minutely from another point of view, the advanced angle chambers 16 comprise the oil paths 8*f* and 8*e* and the retarded angle chambers 17 comprise the oil paths 8*h* and 8*g* (see FIGS. 18 and 19). When a control valve serving as switchover means for switching of a destination, to which the oil paths are connected, is shifted to the advanced angle control and the retarded angle control, the configuration of oil path communication in the upper and lower parts is formed. At the time of the advanced angle control, the oil path 8*f* out of the oil paths 8*f* and 8*e* constitutes an inlet side oil path system to the advanced angle chambers 16 and the oil path 8*g* out of the oil paths 8*g* and 8*h* constitutes an outlet side oil path system (see FIG. 20). Also, at the time of the retarded angle control, the oil path 8*h* out of the oil paths 8*g* and 8*h* constitutes an inlet side oil path system to the retarded angle chambers 17 and the oil path 8*e* out of the oil paths 8*e* and 8*f* constitutes an outlet side oil path system (see FIG. 21).

Figure 23:
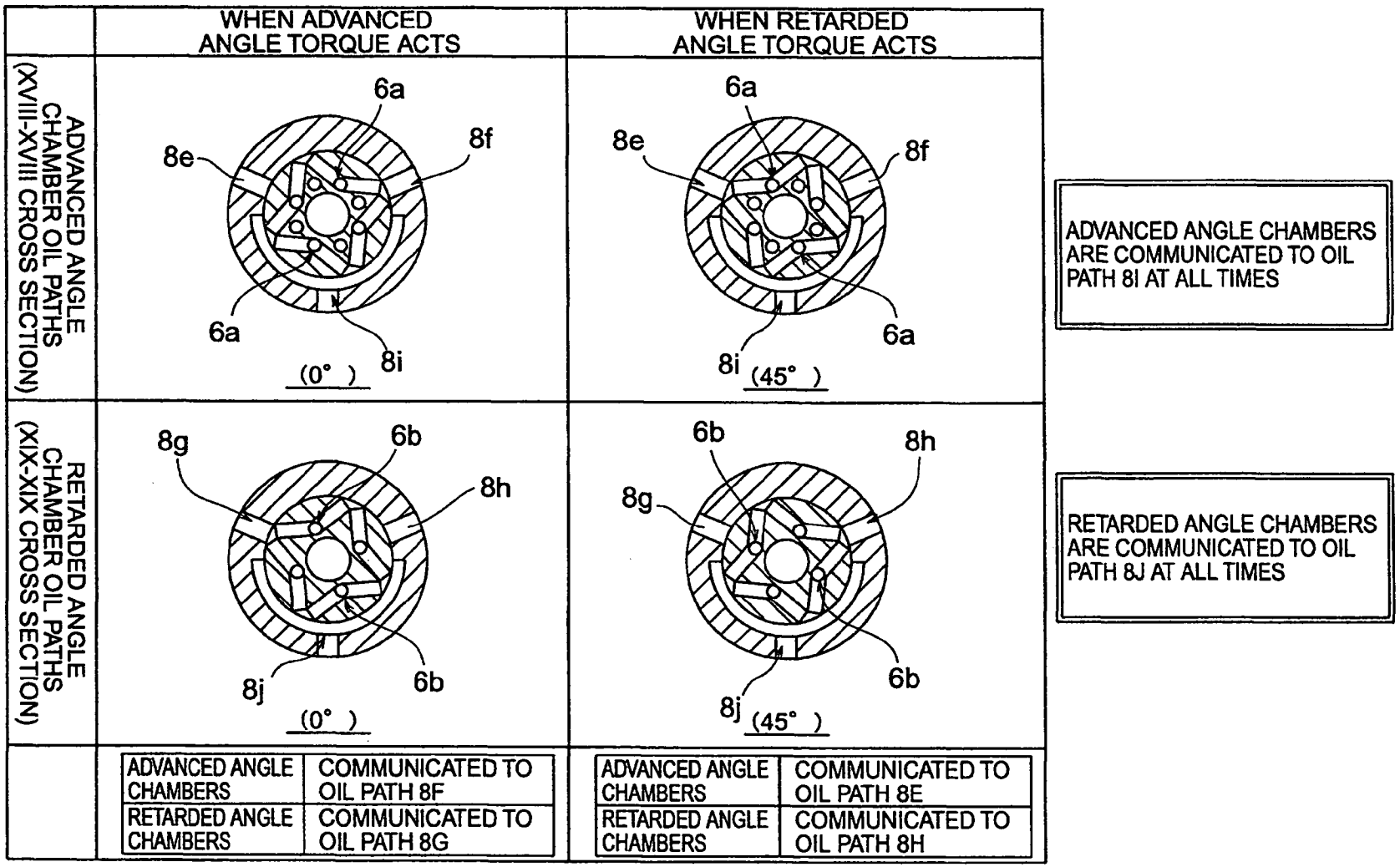
FIG. 23 is a view illustrating an oil path communication when an advanced angle torque or a retarded angle torque acts on a cam shaft in a cam shaft phase adjusting apparatus according to a third embodiment of the invention.
Figure 24:
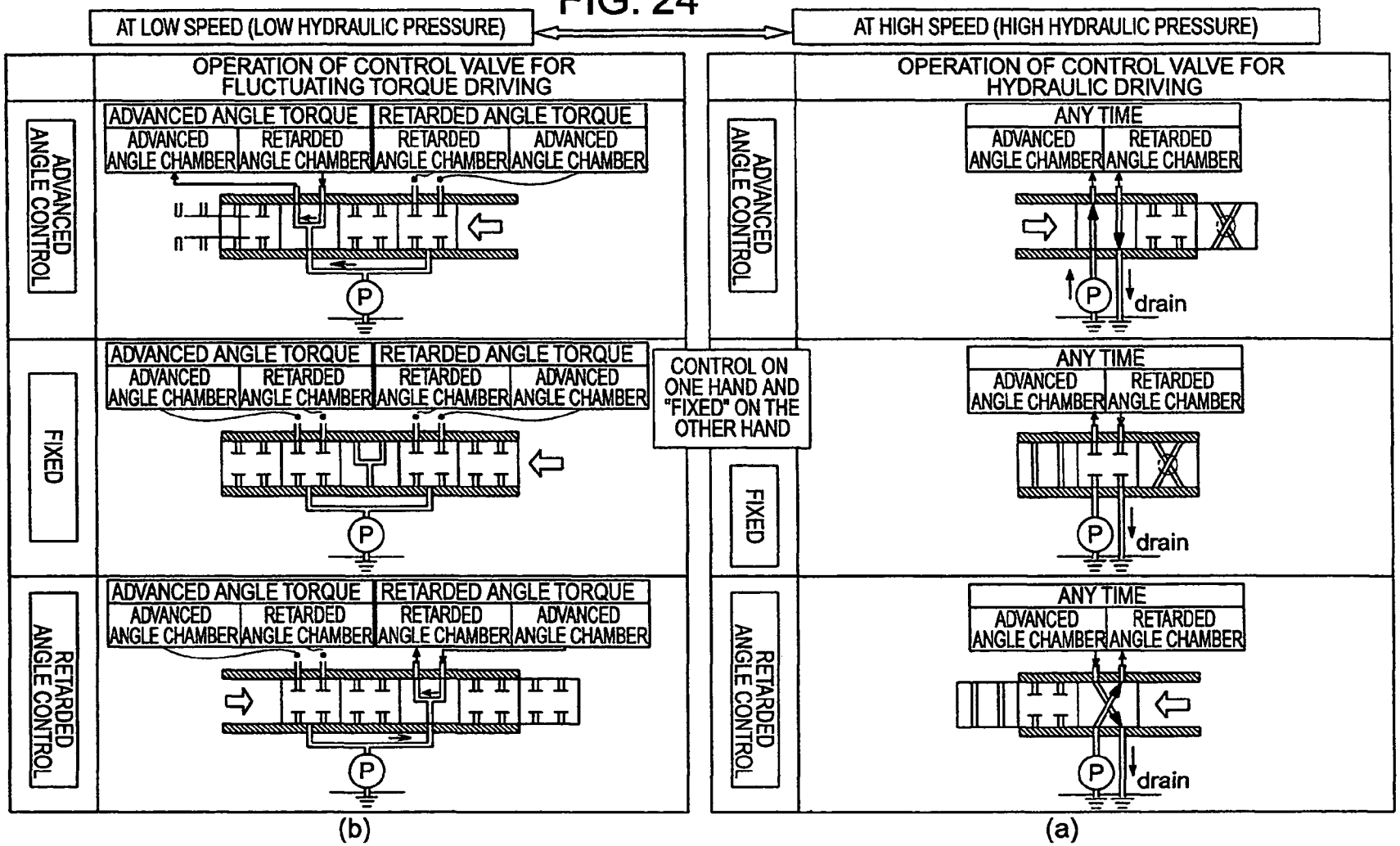
FIG. 24 is a view illustrating proper use of a driving force at low speed (low hydraulic pressure) and at high speed (high hydraulic pressure) in the cam shaft phase adjusting apparatus according to the third embodiment in the case where advanced angle control and retarded angle control are exercised on engine intake and exhaust valves.

Subsequently, a configuration of oil path communication and a configuration of the advanced angle control or the retarded angle control in a cam shaft phase adjusting apparatus according to a third embodiment of the invention will be described with reference to FIGS. 23 and 24. FIG. 23 is a view illustrating oil path communication when the advanced angle torque or the retarded angle torque acts on a cam shaft 6 in the cam shaft phase adjusting apparatus according to the third embodiment of the invention. FIG. 24 is a view illustrating proper use of a driving force at low speed (low hydraulic pressure) and at high speed (high hydraulic pressure) in the cam shaft phase adjusting apparatus according to the third embodiment in the case where the advanced angle control and the retarded angle control are exercised on engine intake and exhaust valves.

The configuration of oil path communication in the third embodiment is different from that in the second embodiment in the number and structure of oil paths provided on a cam shaft bearing 8. While the third embodiment is common to the second embodiment in that the oil paths 8*e* and 8*f* communicated to the advanced angle chambers 16 and the oil paths 8*g* and 8*h* communicated to the retarded angle chambers 17 are provided on the bearing cap of the cam shaft bearing 8, it has a configuration feature in that oil paths are formed over an entire periphery on the lower half of the cam shaft bearing 8, an oil path 8*i* communicated to the advanced angle chambers 16 at all times is formed in XVIII-XVIII cross section of FIG. 16, and an oil path 8*j* communicated to the retarded angle chambers 17 at all times is formed in XIX-XIX cross section of FIG. 19.

In a left and upper part of FIG. 23, when the advanced angle torque acts, the advanced angle chamber oil paths 6*a* which are provide in an upper half of the cam shaft 6 and are communicated to the advanced angle chambers 16 are communicated to the oil path 8*f*, and the advanced angle chamber oil paths 6*a* provided in a lower half of the cam shaft 6 are communicated to the oil path 8*i* at all times. Also, in a right and upper part of FIG. 23, when the retarded angle torque acts, the advanced angle chamber oil paths 6*a* which are provided in the upper half of the cam shaft 6 are communicated to the oil path 8*e* and the advanced angle chamber oil paths 6*a* which are provided in the lower half of the cam shaft 6 are communicated to the oil path 8*i* at all times. Likewise, in a left and lower part of FIG. 23, when the advanced angle torque acts, the retarded angle chamber oil paths 6*b* which are provided in the upper half of the cam shaft 6 are communicated to the oil path, 8*g* and the retarded angle chamber oil paths 6*b* which are provided in the lower half of the cam shaft 6 are communicated to the oil path 8*j* at all times. Also, in a right and lower part of FIG. 20, when the retarded angle torque acts, the retarded angle chamber oil paths 6*b* which are provided in the upper half of the cam shaft 6 are communicated to the oil path 8*h* and the retarded angle chamber oil paths 6*b* which are provided in the lower half of the cam shaft 6 are communicated to the oil path 8*j* at all times.

In other words, the advanced angle chambers 16 are communicated to the oil path 8*f* when the advanced angle torque acts, communicated to the oil path 8*e* when the retarded angle torque acts, and communicated to the oil path 8*i* at all times, and the retarded angle chambers 17 are communicated to the oil path 8*g* when the advanced angle torque acts, communicated to the oil path 8*h* when the retarded angle torque acts, and communicated to the oil path 8*j* at all times. As described later, whether the advanced angle chambers 16 are communicated to the oil path 8*f* or 8*e*, or communicated to the oil path 8*i* at all times is switched according to when an engine is operated at low speed (low hydraulic pressure) and at high speed (high hydraulic pressure) to be applied. Also, whether the retarded angle chambers 17 are communicated to the oil path 8*h* or 8*g*, or communicated to the oil path 8*j* at all times is switched according to when an engine is operated at low speed (low hydraulic pressure) and at high speed (high hydraulic pressure) to be applied.

Subsequently, a drive system, in which the cam shaft is driven in an advanced angle mode (control), a retarded angle mode (control), or a stationary mode (control to fix to a predetermined phase without being moved by the fluctuating torque) with the use of a configuration of oil path communication according to the third embodiment shown in FIG. 23, will be described with reference to FIG. 24.

Cam shaft driving according to the third embodiment is a system, in which a driving force is used properly at low speed (low hydraulic pressure) and at high speed (high hydraulic pressure) such that the fluctuating torque is used as a driving force at low speed and hydraulic pressure is used as a driving force at high speed. In order to properly use a driving force, two control valves having different configurations of oil path communication are used such that one of the control valves is used at low speed and the other of the control valves is used at high speed and that when one of the control valves is used, mutual interference is eliminated by putting the other of the control valves in the stationary mode.

A drive system in FIG. 24(*b*) is the same as that in FIG. 19(*b*), and while details are referred to the descriptions with respect to FIG. 22, the drive system of the third embodiment shown in FIG. 24 is used at low speed (low hydraulic pressure) of an engine. FIG. 24(*a*) shows a drive system, in which the oil paths 8*i* and 8*j* put in communication at all times are used, and there is adopted a configuration of oil path communication, in which the advanced angle chambers 16 are communicated to the oil path 8*i* and the retarded angle chambers 17 are communicated to the oil path 8*j* at all times irrespective of rotated positions (an angle every 90° of peaks of the fluctuating torque) of the cam shaft 6. Such configuration is adopted at high speed (high hydraulic pressure) of the engine. Switchover of the control valves at low speed and at high speed of the engine suffices to be made at an appropriate detected value as a threshold based on, for example, a detected value of engine speed. When the control valves are switched over, the control valve having been used before switchover is set to the stationary mode. By such setting, driving to the advanced angle chambers 16 and the retarded angle chambers 17 by the control valve being used after switchover is not affected.

As seen from the configuration of oil path communication in FIG. 24(*b*), the fluctuating torque is used as a driving force for phase shift in the advanced angle mode and the retarded angle mode at low speed, and hydraulic pressure (hydraulic pressure is made high by high speed rotation of the engine) is used as a driving force for the cam shaft in the advanced angle mode and the retarded angle mode at high speed. In case of setting the advanced angle mode at high speed, the advanced angle chambers 16 are driven by hydraulic pressure at all times but flow of oil is cut off intermittently to brake driving in the advanced angle direction (a decrease in speed of response) and intermittent supply and discharge of oil generates a water hammer (oil hammer) phenomenon as compared with FIG. 22(*a*), since the drive system in FIG. 22(*b*) performs intermittent supply and discharge of oil in the advanced angle mode when the advanced angle torque acts (supply of oil and discharge of oil are performed only in the vicinity of peak positions every 90 degrees, in which the advanced angle torque acts, and intermittent supply and discharge of oil are performed while rotation in the retarded angle direction due to the action of the retarded angle torque is prevented). Still more, since the cam shaft phase adjusting apparatus tends in high speed rotation of the engine to continue phase shift in a direction, in which phase shift is made, a reverse rotation phenomenon (phenomenon, in which the fluctuating torque works in a reverse direction to a direction, in which phase shift is to be made) as at the time of low speed operation is not generated. In this manner, in high speed rotation, in which the reverse rotation phenomenon is hard to generate, the drive system in FIG. 24(*a*) is desirable in terms of speed of response and water hammer phenomenon rather than the drive system in FIG. 22(*a*).

Figure 25:
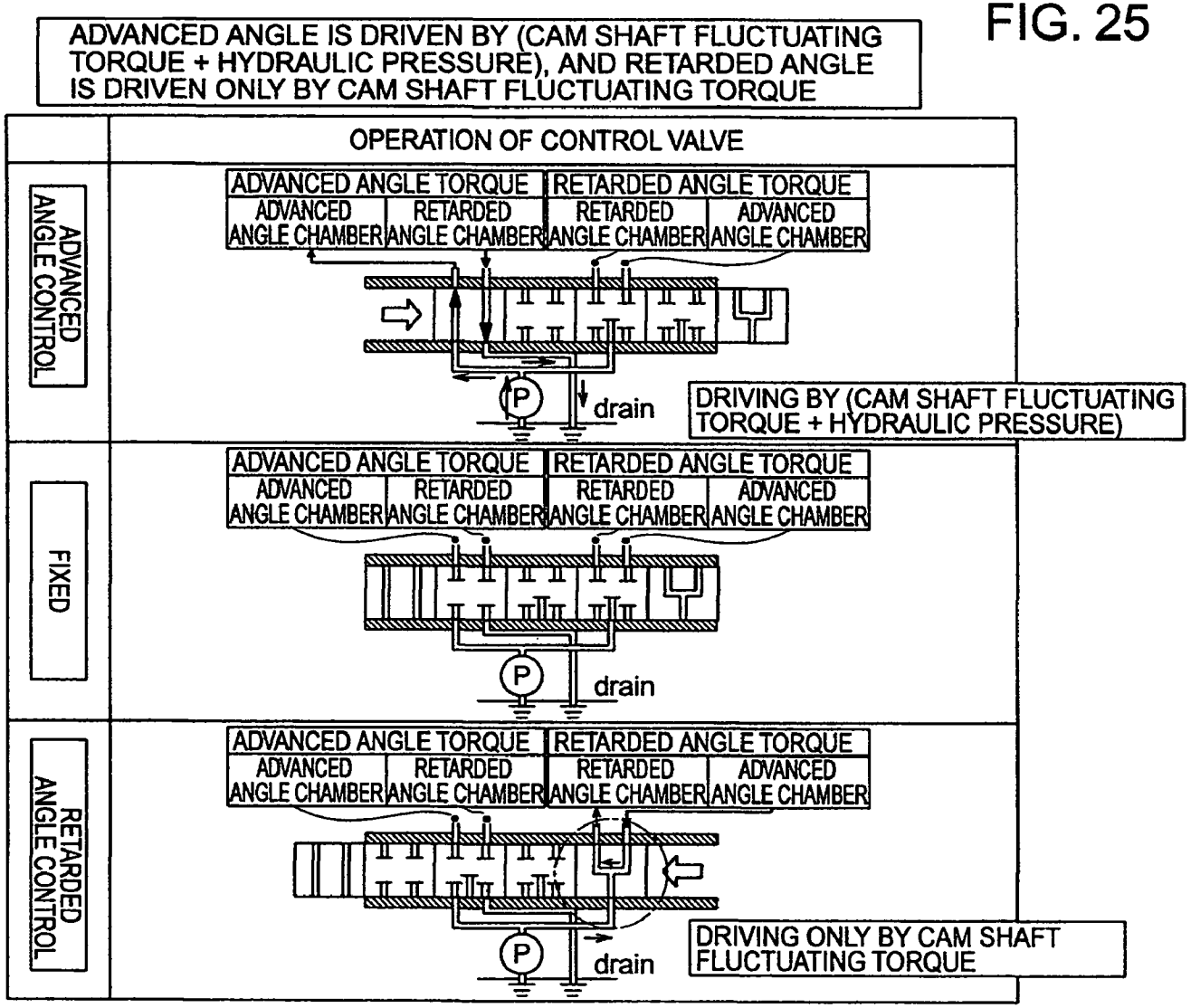
FIG. 25 is a view illustrating a configuration of driving in advanced angle control and retarded angle control in a cam shaft phase adjusting apparatus according to a fourth embodiment of the invention.

Subsequently, a configuration of the advanced angle control or the retarded angle control in a cam shaft phase adjusting apparatus according to a fourth embodiment of the invention will be described with reference to FIG. 25. FIG. 25 illustrates a configuration of driving in the advanced angle control and the retarded angle control in the cam shaft phase adjusting apparatus according to the fourth embodiment of the invention. In FIG. 25, a cam shaft 6 is driven only by the fluctuating torque in the retarded angle control (mode) and the cam shaft 6 is driven by (cam shaft fluctuating torque+hydraulic pressure) in the advanced angle control (mode). Since the cam shaft phase adjusting apparatus has an average tendency such that the retarded, angle torque acts, what is easy to drive with the use of the fluctuating torque is the retarded angle mode. Accordingly, in a lower part of FIG. 25, a control valve is moved leftward in setting of the retarded angle mode and when the retarded angle torque acts, the vane 5 is turned by the retarded angle torque to permit oil to be fed to the retarded angle chambers 17 from the advanced angle chambers 16 whereby the cam shaft 6 is driven in the retarded angle direction.

In setting to the advanced angle mode (phase shift is desired in the advanced angle direction), the control valve is moved rightward to define oil paths, through which oil is supplied to the advanced angle chambers 16 from a hydraulic power source P and oil is discharged to a drain from the retarded angle chambers 17 when the advanced angle torque acts. When the retarded angle torque acts, both the advanced angle chambers 16 and the retarded angle chambers 17 are made closed spaces. That is, in the advanced angle mode, the cam shaft 6 is driven by (fluctuating torque+hydraulic pressure) and phase shift is made in the advanced angle direction when the advanced angle torque acts. Also, in a stationary mode, both the advanced angle chambers 16 and the retarded angle chambers 17 are made closed spaces and fixed to a predetermined phase both when the advanced angle torque acts and when the retarded angle torque acts.

As described above, the embodiments of the invention have a feature in providing the following construction and function with a view to attaining the following object. That is, it is an object to use an intermittent oil supply system to enable realizing high response at low speed both in a direction of advanced angle and in a direction of retarded angle, and to switch between a conventional continuous oil supply system and the intermittent oil supply system at need in order to avoid generation of a disadvantage such as that decrease in speed of response, which is generated by the intermittent oil supply system at the time of high speed operation, a water hammer phenomenon, etc.

In order to attain such object, the embodiments provide a cam shaft phase adjusting apparatus for internal combustion engines, provided between a crankshaft and a cam shaft to have phase shift means, which includes an advanced angle hydraulic chamber, which is increased in volume when a phase angle of a cam shaft relative to a crankshaft changes in a direction of advanced angle, and a retarded angle hydraulic chamber, which is increased in volume when a phase angle of the cam shaft relative to the crankshaft changes in a direction of retarded angle, and comprising first and second oil path systems, which are independent from each other and communicated to the advanced angle hydraulic chamber in respective ranges of predetermined rotating angles according to a change in rotating angle of the cam shaft, third and fourth oil path systems, which are independent from each other and communicated to the retarded angle hydraulic chamber in respective ranges of predetermined rotating angles according to a change in rotating angle of the cam shaft, a first switchover unit, which performs switching between communication and cut-off according to a rotating angle of the cam shaft such that one of the first and second oil path systems is put in a state of being cut off from the advanced angle hydraulic chamber in a state, in which the other of the first and second oil path systems is communicated to the advanced angle hydraulic chamber, and a second switchover unit, which performs switching between communication and cut-off according to the rotating angle such that one of the third and fourth oil path systems is put in a state of being cut off from the retarded angle hydraulic chamber in a state, in which the other of the third and fourth oil path systems is communicated to the retarded angle hydraulic chamber.

Thereby, it is possible to constitute a pair of oil path systems communicated to the advanced angle chamber and oil path systems communicated to the retarded angle chamber when fluctuating torque acting on the cam shaft is directed in the direction of advanced angle. These oil path systems are referred to as advanced angle occasion oil supply system and advanced angle occasion oil drain system, respectively. Also, at the same time, it is possible to constitute a pair of oil path systems communicated to the advanced angle chamber and oil path systems communicated to the retarded angle chamber when fluctuating torque acting on the cam shaft is directed in the direction of retarded angle. These oil path systems are referred to as retarded angle occasion oil drain system and retarded angle occasion oil supply system, respectively.

Also, the embodiment comprises means for switching between a mode, in which the advanced angle occasion oil drain system is connected to a drain simultaneously when the advanced angle occasion oil supply system is connected to a hydraulic power source, and a mode, in which the retarded angle occasion oil supply system is connected to the hydraulic power source simultaneously when the retarded angle occasion oil drain system is connected to the drain. Thereby, in the case where phase shift in the direction of advanced angle is desired in the cam shaft phase adjusting apparatus, hydraulic pressure is supplied to the advanced angle chamber and oil is discharged from the retarded angle chamber when fluctuating torque in the direction of advanced angle acts, whereby phase shift is caused at high speed in the direction of advanced angle by both the fluctuating torque and the hydraulic pressure, and when fluctuating torque in the direction of retarded angle acts, the advanced angle chamber and the retarded angle chamber, respectively, are made closed spaces and reverse rotation in the direction of retarded angle can be prevented by the fluctuating torque. That is, the intermittent oil supply system enables improving phase shift in speed in the direction of advanced angle. Also, in the case where phase shift in the direction of retarded angle is desired in the cam shaft phase adjusting apparatus, hydraulic pressure is supplied to the retarded angle chamber and oil is discharged from the advanced angle chamber when fluctuating torque in the direction of retarded angle acts, whereby phase shift is caused at high speed in the direction of retarded angle by both the fluctuating torque and the hydraulic pressure, and when fluctuating torque in the direction of advanced angle acts, the advanced angle chamber and the retarded angle chamber, respectively, are made closed spaces and reverse rotation in the direction of advanced angle can be prevented by the fluctuating torque. That is, the intermittent oil supply system enables improving phase shift in speed in the direction of retarded angle.

Further, the embodiment comprises a communication switchover unit, which provides communication or cut-off between the advanced angle occasion oil supply system and the retarded angle occasion oil drain system, and a communication switchover unit, which provides communication or cut-off between the retarded angle occasion oil supply system and the advanced angle occasion oil drain system. Both the advanced angle occasion oil supply system and the retarded angle occasion oil drain system comprise first and second oil path systems, which are communicated to the advanced angle hydraulic chamber and independent from each other, and both the retarded angle occasion oil supply system and the advanced angle occasion oil drain system comprise third and fourth oil path systems, which are communicated to the retarded angle hydraulic chamber and independent from each other. The individual oil path systems are intermittently communicated to the respective hydraulic chambers but communicated to each other by the communication switchover unit, whereby it is possible to constitute an oil path system communicated to the advanced angle hydraulic chamber at all times and an oil path system communicated to the retarded angle hydraulic chamber at all times. That is, it is possible to switch over to a conventional continuous oil supply system for cam shaft phase adjusting apparatuses.

When an internal combustion engine rotates at high speed, since a sufficient hydraulic pressure for driving of a cam shaft phase adjusting apparatus is obtained and a period, during which a reverse torque acts, is decreased, and since fluctuating torque acting on the cam shaft is increased in frequency, influences of inertia increase, so that a phenomenon, in which the cam shaft phase adjusting apparatus is reversely rotated in a desired direction of driving, is hard to occur. When the intermittent supply and discharge of oil described above is performed in the case where such reversal phenomenon is absent, oil supply and discharge paths in the cam shaft phase adjusting apparatus in the course of phase shift are cut off whereby braking is applied to cause a decrease in shift speed and a water hammer phenomenon. In such occasion, switching over to the conventional continuous hydraulic path makes it possible to avoid a disadvantage such as that decrease in shift speed at the time of high speed operation, a water hammer phenomenon, etc.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A cam shaft phase adjusting apparatus for an internal combustion engine, comprising:

phase shift device, which performs phase shift between a crankshaft and a cam shaft and includes advanced angle hydraulic chambers, which are increased in volume when a phase angle of the cam shaft relative to the crankshaft changes in a direction of advanced angle, and retarded angle hydraulic chambers, which are increased in volume when a phase angle of the cam shaft relative to the crankshaft changes in a direction of retarded angle;

a plurality of advanced angle chamber oil path systems which are communicated to the advanced angle hydraulic chambers according to change in rotating angle of the cam shaft;

a plurality of retarded angle chamber oil path systems which are communicated to the retarded angle hydraulic chambers according to change in rotating angle of the cam shaft; and a switchover device to switch communication and cut-off according to a rotating angle of the cam shaft such that one of the plurality of advanced angle chamber oil path systems is cut off from the advanced angle hydraulic chambers while the other of the plurality of advanced angle chamber oil path systems is communicated to the advanced angle hydraulic chambers, and one of the plurality of retarded angle chamber oil path systems is cut off from the retarded angle hydraulic chambers while the other of the plurality of retarded angle chamber oil path systems is communicated to the retarded angle hydraulic chambers.

2. A cam shaft phase adjusting apparatus for an internal combustion engine, comprising:

phase shift device, which performs phase shift between a crankshaft and a cam shaft and includes advanced angle hydraulic chambers, which are increased in volume when a phase angle of the cam shaft relative to the crankshaft changes in a direction of advanced angle, and retarded angle hydraulic chambers, which are increased in volume when a phase angle of the cam shaft relative to the crankshaft changes in a direction of retarded angle;

first and second oil path systems, which are independent from each other and are communicated to the advanced angle hydraulic chambers, according to change in rotating angle of the cam shaft, in respective predetermined rotating angle ranges of the cam shaft, third and fourth oil path systems, which are independent from each other and are communicated to the retarded angle hydraulic chambers, according to a change in rotating angle of the cam shaft, in respective predetermined rotating angle ranges of the cam shaft;

a first switchover unit, which performs switching between communication and cut-off according to a rotating angle of the cam shaft such that one of the first and second oil path systems is cut off from the advanced angle hydraulic chambers while the other of the first and second oil path systems is communicated to the advanced angle hydraulic chambers, and a second switchover unit, which performs switching between communication and cut-off according to a rotating angle of the cam shaft such that one of the third and fourth oil path systems is cut off from the retarded angle hydraulic chambers while the other of the third and fourth oil path systems is communicated to the retarded angle hydraulic chambers.

3. The cam shaft phase adjusting apparatus according to claim 2, wherein one of the first and second oil path systems is an inlet side oil path system and the other is an outlet side oil path system, and one of the third and fourth oil path systems is an inlet side oil path system and the other is an outlet side oil path system.

4. The cam shaft phase adjusting apparatus according to claim 3, further comprising switchover means, which performs switching among designations, to which the first, second, third and fourth oil path systems are connected, and wherein the switchover means performs switching between a mode, in which the inlet side oil path system out of the first and second oil path systems is connected to a hydraulic power source and the outlet side oil path system out of the third and fourth oil path systems is connected to a drain, and a mode, in which the outlet side oil path system out of the first and second oil path systems is connected to the drain and the inlet side oil path system out of the third and fourth oil path systems is connected to the hydraulic power source.

5. The cam shaft phase adjusting apparatus according to claim 3, further comprising switchover means, which performs switching among designations, to which the first, second, third and fourth oil path systems are connected, and wherein the switchover means performs switching between a mode, in which the inlet side oil path system out of the first and second oil path systems is connected to the outlet side oil path system out of the third and fourth oil path systems, and a mode, in which the inlet side oil path system out of the third and fourth oil path systems is connected to the outlet side oil path system out of the first and second oil path systems.

6. A cam shaft phase adjusting apparatus for an internal combustion engine, comprising:

phase shift device, which performs phase shift between a crankshaft and a cam shaft and includes advanced angle hydraulic chambers, which are increased in volume when a phase angle of the cam shaft relative to the crankshaft changes in a direction of advanced angle, and retarded angle hydraulic chambers, which are increased in volume when a phase angle of the cam shaft relative to the crankshaft changes in a direction of retarded angle;

first and second oil path systems, which are communicated to the advanced angle hydraulic chambers in respective predetermined angle ranges when a phase angle of the cam shaft relative to the crankshaft changes; and third and fourth oil path systems, which are communicated to the retarded angle hydraulic chambers in respective predetermined angle ranges when a phase angle of the cam shaft relative to the crankshaft changes;

a fifth oil path system communicated to the advanced angle hydraulic chambers at all times; and a sixth oil path system communicated to the retarded angle hydraulic chambers at all times, and wherein the first and second oil path systems are provided as mutually independent oil path systems and provided to have a phase angle range so that one of them is cut off from the advanced angle hydraulic chambers when the other is communicated to the advanced angle hydraulic chambers, and the third and fourth oil path systems are provided as mutually independent oil path systems and provided to have a phase angle range so that one of them is cut off from the retarded angle hydraulic chambers when the other is communicated to the retarded angle hydraulic chambers.

7. The cam shaft phase adjusting apparatus according to claim 6, wherein supply and discharge of oil from the fifth and sixth oil path systems are performed by switchover means, which is controlled independently of supply and discharge of oil from the third and fourth oil path systems.

8. The cam shaft phase adjusting apparatus according to claim 7, wherein the independently controlled switchover means is switched according to a rotating speed of the internal combustion engine.

9. A cam shaft phase adjusting apparatus for an internal combustion engine, comprising:

phase shift device, which performs phase shift between a crankshaft and a cam shaft and includes advanced angle hydraulic chambers, which are increased in volume when a phase angle of the cam shaft relative to the crankshaft changes in a direction of advanced angle, and retarded angle hydraulic chambers, which are increased in volume when a phase angle of the cam shaft relative to the crankshaft changes in a direction of retarded angle;

a plurality of advanced angle chamber oil path systems which are communicated to the advanced angle hydraulic chambers according to a rotating angle of the cam shaft;

a plurality of retarded angle chamber oil path systems which are communicated to the retarded angle hydraulic chambers according to a rotating angle of the cam shaft;

an intermittent switchover unit for switching between communication and cut-off according to a rotating angle of the cam shaft such that one of the plurality of advanced angle chamber oil path systems is cut off from the advanced angle hydraulic chambers while the other of the plurality of advanced angle chamber oil path systems is communicated to the advanced angle hydraulic chambers, and one of the plurality of retarded angle chamber oil path systems is cut off from the retarded angle hydraulic chambers while the other of the plurality of retarded angle chamber oil path systems is communicated to the retarded angle hydraulic chambers; and a communication switchover unit, which provides communication or cut-off between the plurality of advanced angle chamber oil path systems and provides communication or cut-off between the plurality of retarded angle chamber oil path systems according to a rotating angle of the cam shaft.

10. The cam shaft phase adjusting apparatus according to claim 9, wherein the communication switchover unit synchronously performs communication or cut-off between the retarded angle chamber oil path systems and the advanced angle chamber oil path systems.

11. A cam shaft phase adjusting apparatus for an internal combustion engine, comprising:

phase shift device, which performs phase shift between a crankshaft and a cam shaft and includes advanced angle hydraulic chambers, which are increased in volume when a phase angle of the cam shaft relative to the crankshaft changes in a direction of advanced angle, and retarded angle hydraulic chambers, which are increased in volume when a phase angle of the cam shaft relative to the crankshaft changes in a direction of retarded angle;

first and second oil path systems, which are independent from each other and are communicated to the advanced angle hydraulic chambers in respective predetermined rotating angle ranges according to a change in rotating angle of the cam shaft;

third and fourth oil path systems, which are independent from each other and are communicated to the retarded angle hydraulic chambers in respective predetermined rotating angle ranges according to a change in rotating angle of the cam shaft;

a first switchover unit, which performs switching between communication and cut-off according to a rotating angle of the cam shaft such that one of the first and second oil path systems is cut off from the advanced angle hydraulic chambers while the other of the first and second oil path systems is communicated to the advanced angle hydraulic chambers;

a second switchover unit, which performs switching between communication and cut-off according to a rotating angle of the cam shaft such that one of the third and fourth oil path systems is cut off from the retarded angle hydraulic chambers while the other of the third and fourth oil path systems is communicated to the retarded angle hydraulic chambers; and switchover means, which performs switching among designations, to which the first, second, third and fourth oil path systems are connected, and wherein one of the first and second oil path systems is an inlet side oil path system and the other is an outlet side oil path system, and one of the third and fourth oil path systems is an inlet side oil path system and the other is an outlet side oil path system, wherein the switchover means performs switching between an advanced angle mode, in which the inlet side oil path system out of the first and second oil path systems is connected to a hydraulic power source and the outlet side oil path system out of the third and fourth oil path systems is connected to a drain, and a retarded angle mode, in which the inlet side oil path system out of the third and fourth oil path systems is connected to the outlet side oil path system out of the first and second oil path systems, whereby when a phase angle of the cam shaft acts in the direction of advanced angle in the advanced angle mode, phase shift of the cam shaft is performed through the advanced angle hydraulic chambers by the hydraulic power source and the drain and by the acting torque in the direction of advanced angle, and when a phase angle of the cam shaft acts in the direction of retarded angle in the retarded angle mode, phase shift of the cam shaft is performed through the advanced angle hydraulic chambers by the acting torque in the direction of retarded angle.

* * * * *